US006287223B1

(12) United States Patent
Liechty, II

(10) Patent No.: US 6,287,223 B1
(45) Date of Patent: Sep. 11, 2001

(54) DULLING PREVENTION FOR SHARP CUTTING EDGE OF BLADE-OPENING ARROWHEAD BLADES WHEN IN A CLOSED IN-FLIGHT POSITION

(76) Inventor: Victor Jay Liechty, II, 1250 N. 1750 W., Provo, UT (US) 84604

( * ) Notice: Subject to any disclaimer, the term of this patent is extended or adjusted under 35 U.S.C. 154(b) by 0 days.

(21) Appl. No.: 09/303,762

(22) Filed: May 3, 1999

Related U.S. Application Data

(63) Continuation-in-part of application No. 08/834,478, filed on Apr. 11, 1997, now abandoned.

(51) Int. Cl.[7] ..... F42B 6/08
(52) U.S. Cl. ..... 473/583
(58) Field of Search ..... 473/582, 583, 473/584, FOR 219, FOR 221, FOR 222

(56) References Cited

U.S. PATENT DOCUMENTS

| | | |
|---|---|---|
| D. 279,813 | 7/1985 | Palizzolo . |
| 1,604,713 | 10/1926 | Norlund . |
| 2,289,284 | 7/1942 | Chandler . |
| 2,568,417 | 9/1951 | Steinbacher . |
| 2,620,190 | 12/1952 | Bean . |
| 2,820,634 | 1/1958 | Vance . |
| 2,939,708 | 6/1960 | Scheib . |
| 2,993,697 | 7/1961 | Urban . |
| 3,000,635 | 9/1961 | Nieman . |
| 3,014,305 | 12/1961 | Yurchich . |
| 3,022,077 | 2/1962 | Doonan . |
| 3,036,395 | 5/1962 | Nelson . |
| 3,036,396 | 5/1962 | Swails . |
| 3,064,977 | 11/1962 | Zwickey . |
| 3,138,383 | 6/1964 | McKenzie . |
| 3,168,313 | 2/1965 | Lins . |
| 3,241,836 | 3/1966 | Zwickey . |
| 3,578,328 | 5/1971 | Rickey . |
| 3,600,835 | 8/1971 | Hendricks . |
| 3,738,657 | 6/1973 | Cox . |
| 3,759,519 | 9/1973 | Palma . |
| 4,099,720 | 7/1978 | Zeren . |
| 4,166,619 | 9/1979 | Bergmann et al. . |
| 4,452,460 | 6/1984 | Adams . |
| 4,504,063 | 3/1985 | Le Bus . |
| 4,565,377 | 1/1986 | Troncoso et al. . |
| 4,579,348 | 4/1986 | Jones . |
| 4,615,529 | 10/1986 | Vocal . |
| 4,729,320 | 3/1988 | Whitten . |
| 4,807,382 | 2/1989 | Albrecht ..... 43/6 |
| 4,932,671 | 6/1990 | Anderson . |
| 4,940,246 | 7/1990 | Stagg . |
| 4,973,060 | 11/1990 | Herzing . |
| 4,976,443 | 12/1990 | Delucia . |
| 4,988,112 | 1/1991 | Anderson et al. . |
| 4,998,738 | 3/1991 | Puckett . |
| 5,044,640 | 9/1991 | Del Monte et al. . |
| 5,046,744 | 9/1991 | Eddy . |
| 5,066,021 | 11/1991 | De Lucia . |
| 5,078,407 | 1/1992 | Carlston et al. . |
| 5,082,292 | 1/1992 | Puckett et al. . |

(List continued on next page.)

OTHER PUBLICATIONS

Packaging: "Mini–Max3", Mar–Den Inc. Wilcox, AZ.
Packaging: "Jackhammer–SST" WASP Archery Products Inc. Plymouth, CT.
Advertisement: Rocket Aeroheads—Steelhead 125 Bowmasters Nov. 1998 p. 23.

(List continued on next page.)

*Primary Examiner*—John A. Ricci

(57) ABSTRACT

Blade-opening arrowheads with removably attachable piv otal blades, each having an edge with at least a section thereof that is sharpened for cutting. The sharp cutting edges are prevented from being dulled from contact with their corresponding arrowhead bodies, arrowhead tips or other structure when the blades are folded into a retracted in-flight position or into a closed position.

27 Claims, 21 Drawing Sheets

U.S. PATENT DOCUMENTS

| | | | |
|---|---|---|---|
| 5,083,798 | 1/1992 | Massey . | |
| 5,090,709 | 2/1992 | Johnson . | |
| 5,100,143 | 3/1992 | Puckett . | |
| 5,102,147 | 4/1992 | Szeluga . | |
| 5,112,063 | 5/1992 | Puckett . | |
| 5,172,916 | 12/1992 | Puckett . | |
| 5,178,398 | 1/1993 | Eddy . | |
| 5,286,035 | 2/1994 | Ward . | |
| 5,322,297 | 6/1994 | Smith . | |
| 5,458,341 | 10/1995 | Forrest et al. . | |
| 5,472,213 | 12/1995 | Dudley . | |
| 5,564,713 | 10/1996 | Mizek et al. . | |
| 5,803,844 | 9/1998 | Anderson | 473/583 |
| 5,803,845 | 9/1998 | Anderson | 473/583 |
| 5,820,498 | 10/1998 | Maleski | 473/584 |
| 5,857,930 | 1/1999 | Troncoso | 473/583 |
| 5,879,252 | 3/1999 | Johnson | 473/583 |

OTHER PUBLICATIONS

Advertisement: Knife Wing Arrowheads—Knife Wing II as in ABCC "ad book " 4th Ed. Apr. 1, 1995 p. K–2.

Shockwave Mechanical Broadhead—New Archery Products Archery Business May/Jun. 1999 p. 7.

272
270
200
230
252
250
230
450
454
414
400
420
520
500
510

370

8
8
324
320
300
322
390
346
330
392
342
344
340
450

454
400

414
100
290
274
800
270
320
300
300
200
800
346
710
450
800
720
342
252
400
520
420
500
230

230

FIG. 14
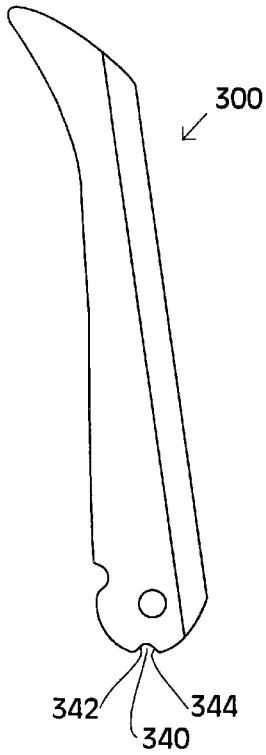
FIG. 15
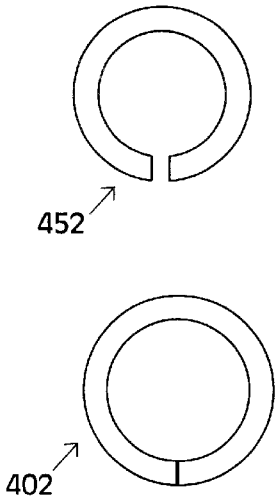
FIG. 16
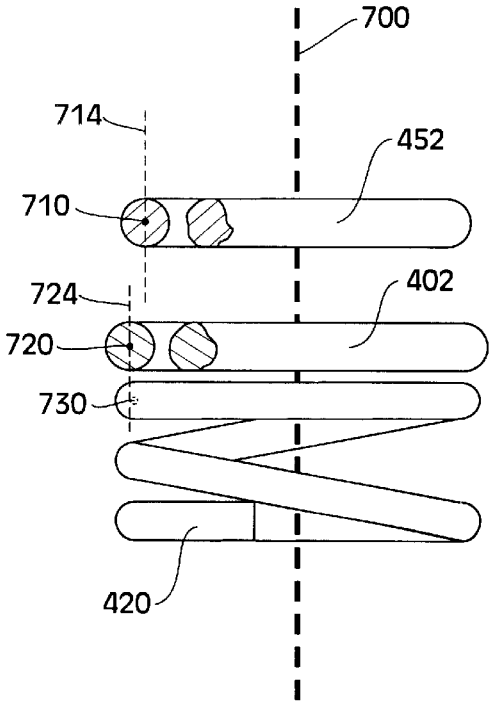
FIG. 13
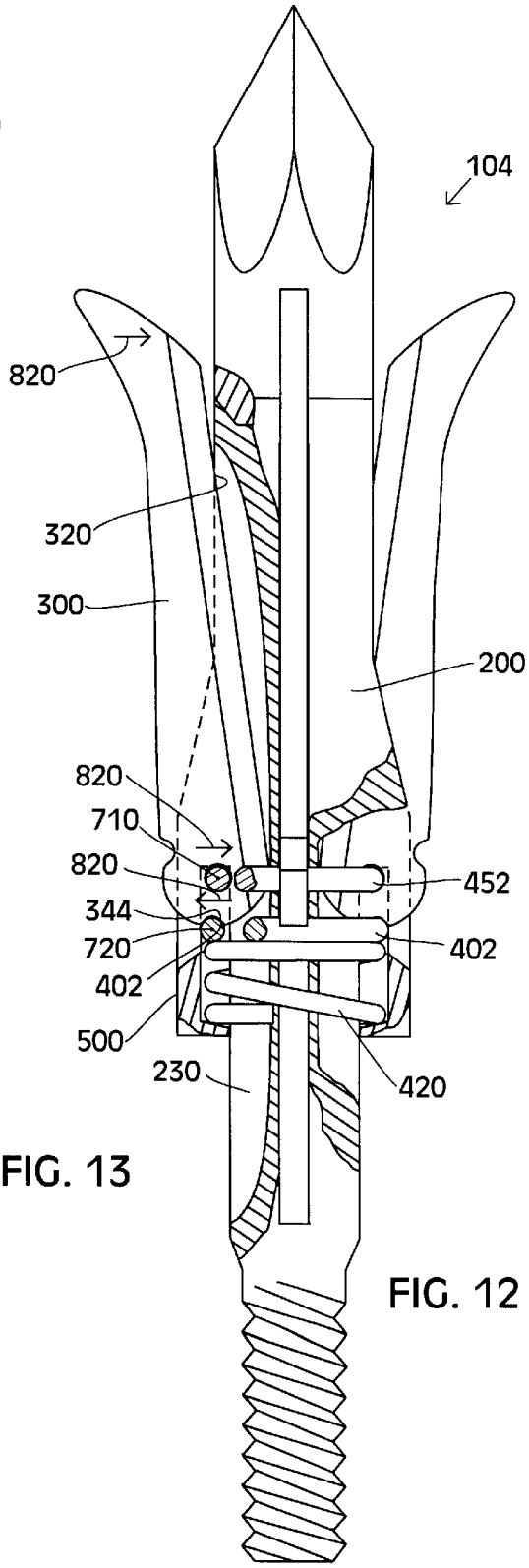
FIG. 12

FIG. 18
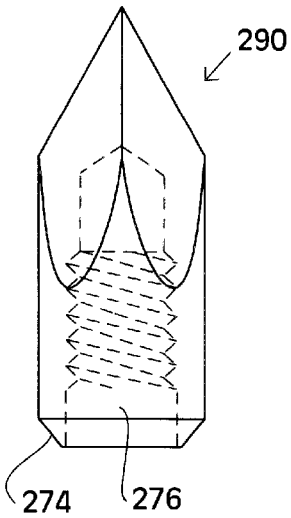
FIG. 19
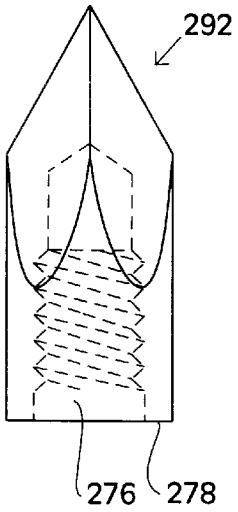
FIG. 20
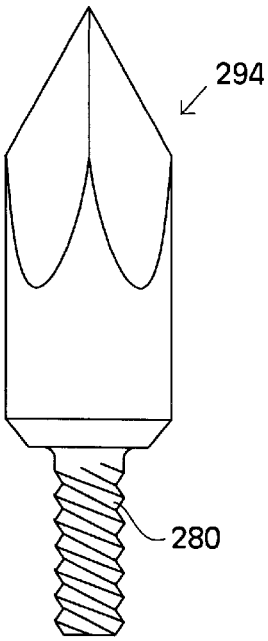
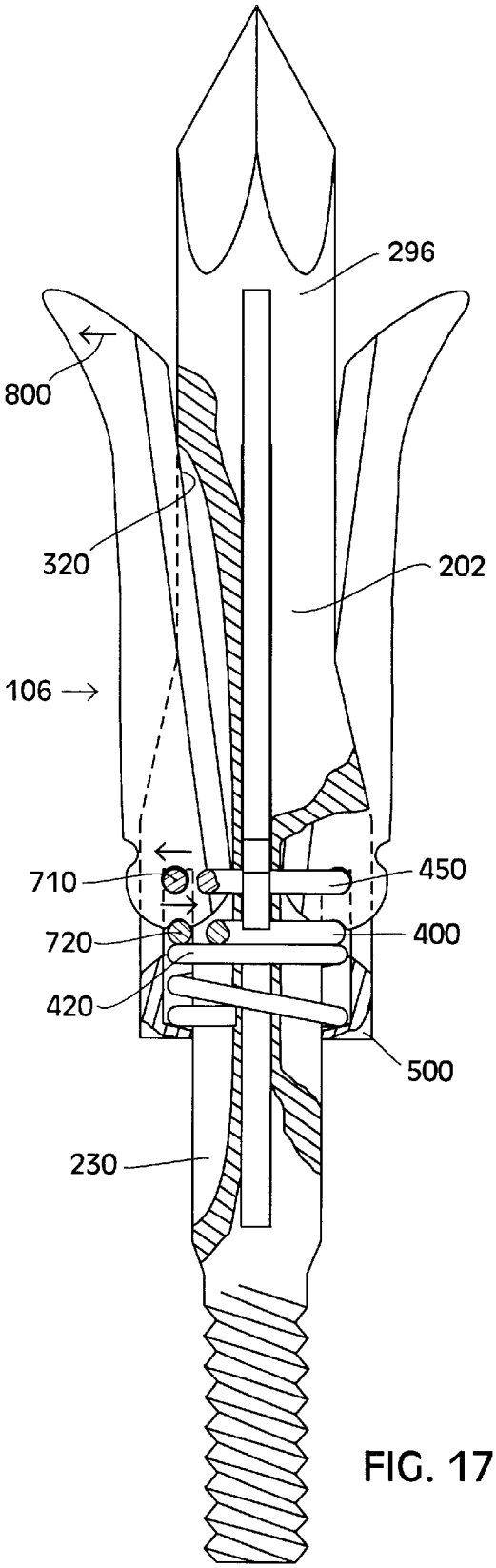
FIG. 17

FIG. 21
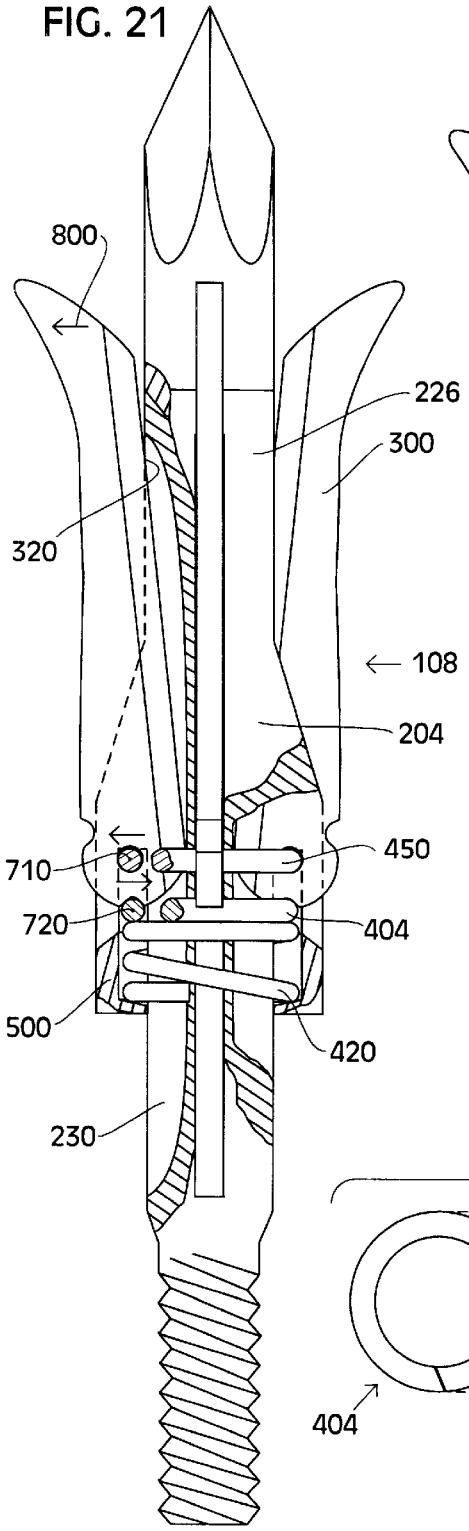
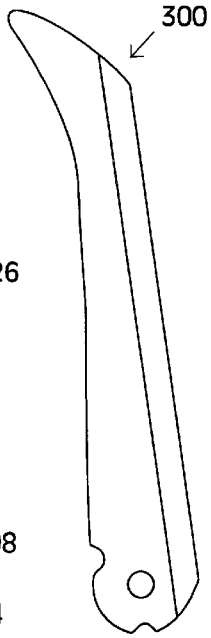
FIG. 23
FIG. 22
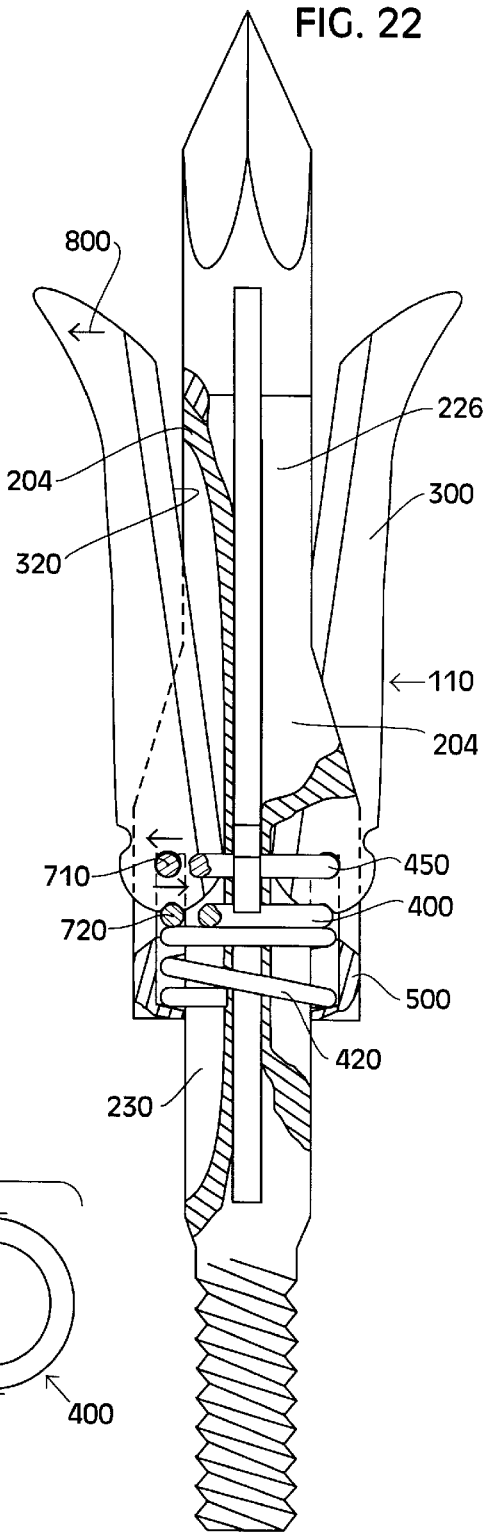
FIG. 24
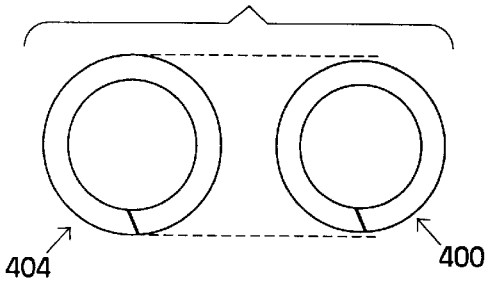

FIG. 25
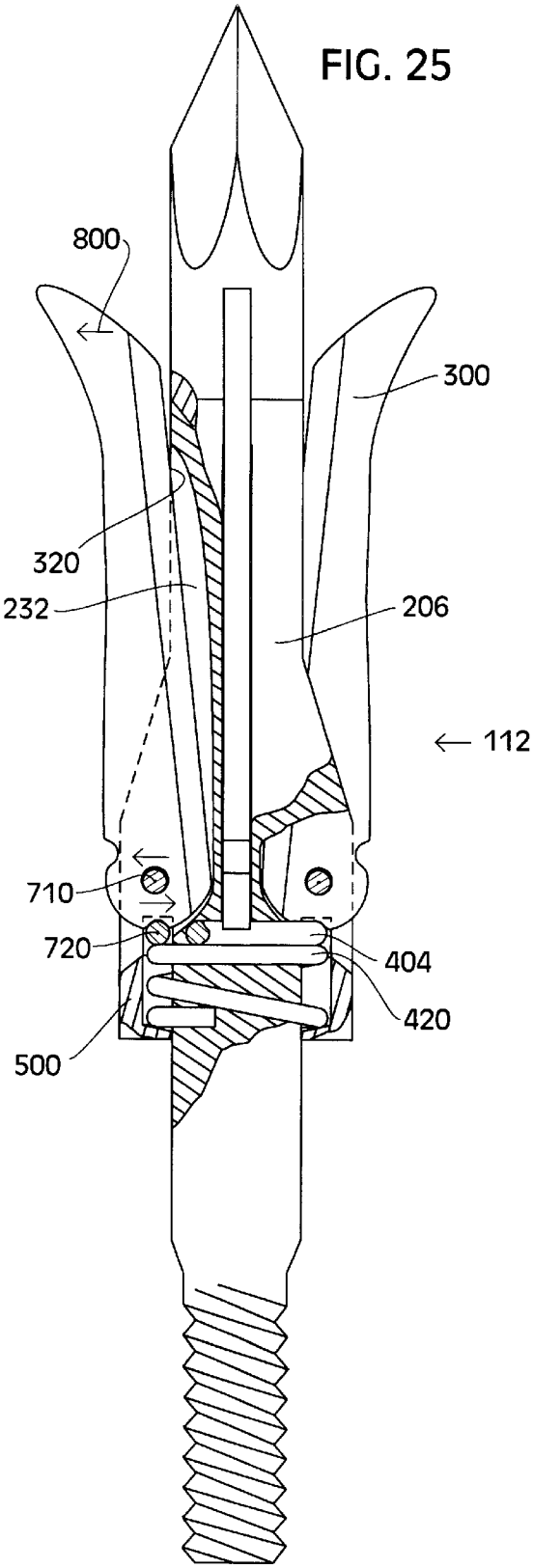
FIG. 26
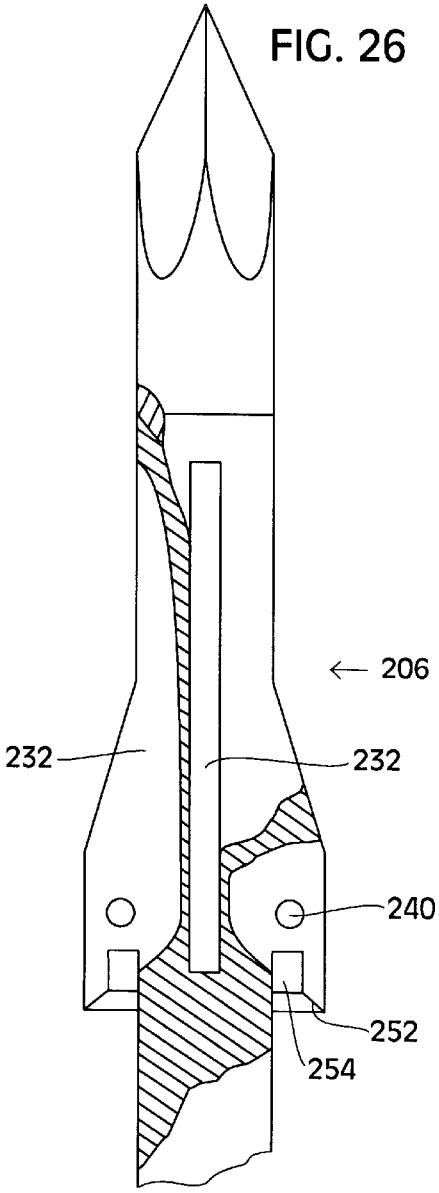
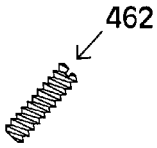
FIG. 27
FIG. 28
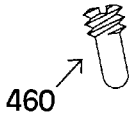

820
298
600
300
114
200
320
452
710
720
402
500
420

298
260

600

298
600
350
800
304
116
200
320
710
450
720
400
420
230
350
352
354
356
304
306

FIG. 35
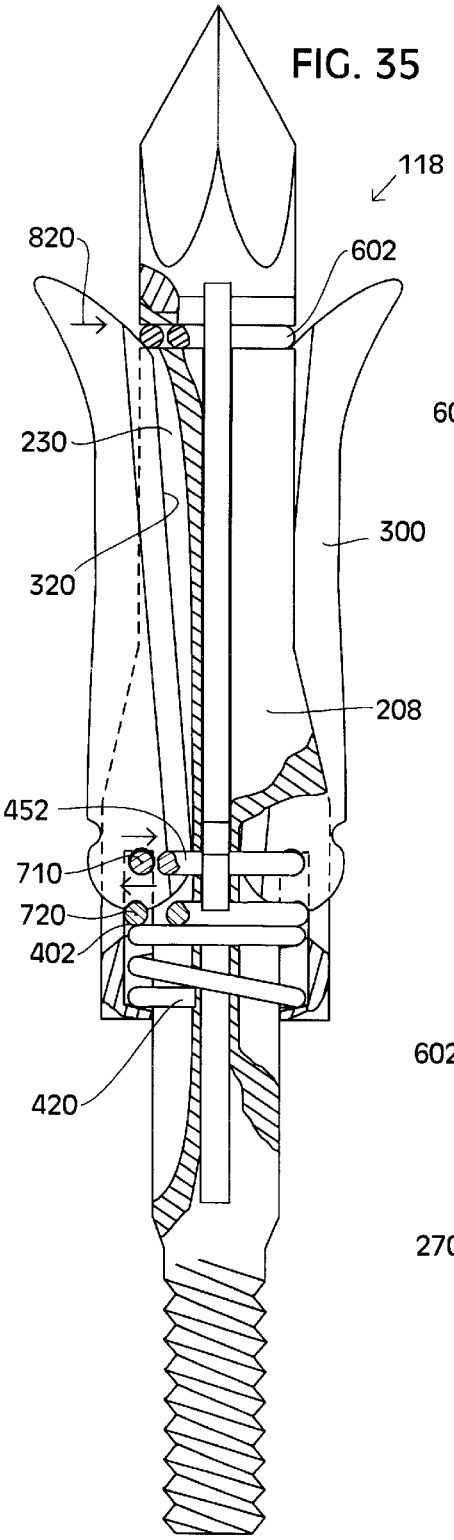
FIG. 40
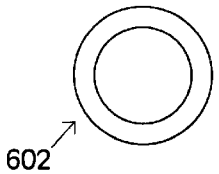
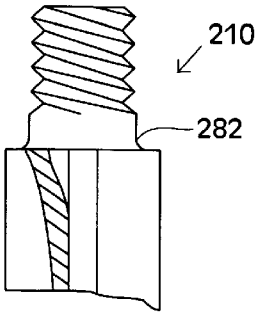
FIG. 39
FIG. 37
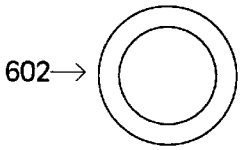
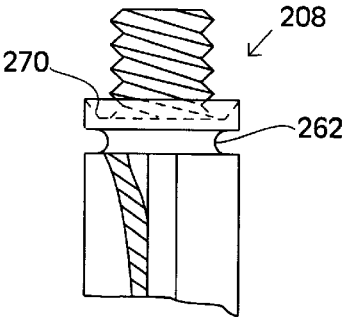
FIG. 36
FIG. 38
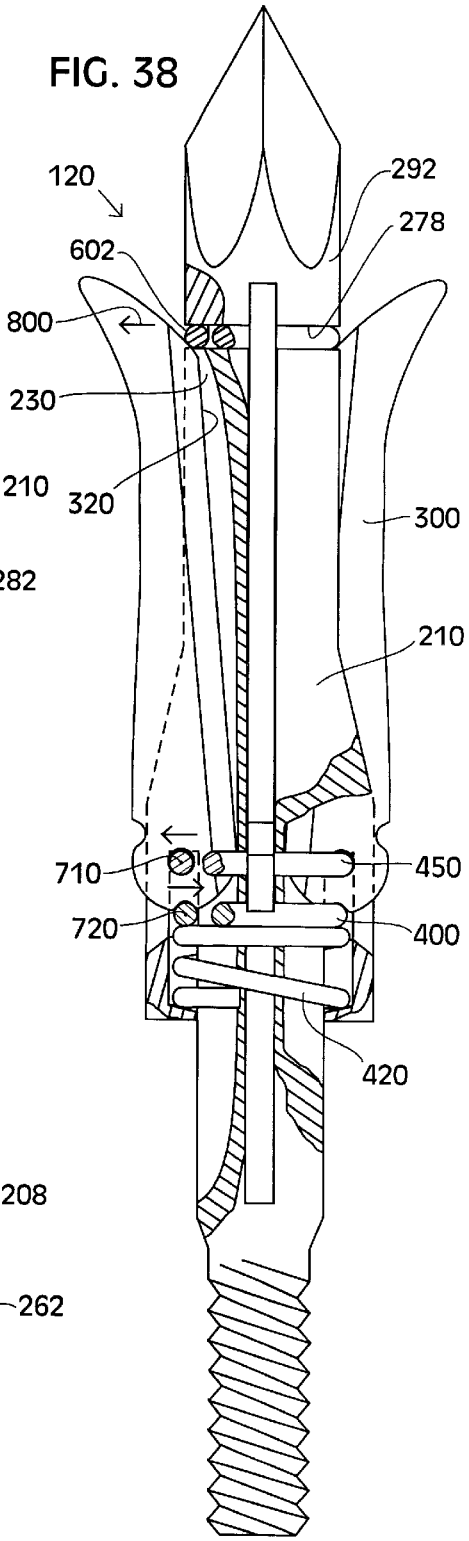

122
604
295
800
358
320
308
212
450
710
720
400
500
420
230

606
460

462

124
293
606
264
720
360
278
320
310
214
240
710
460
234
502
358
360
308
310

FIG. 48
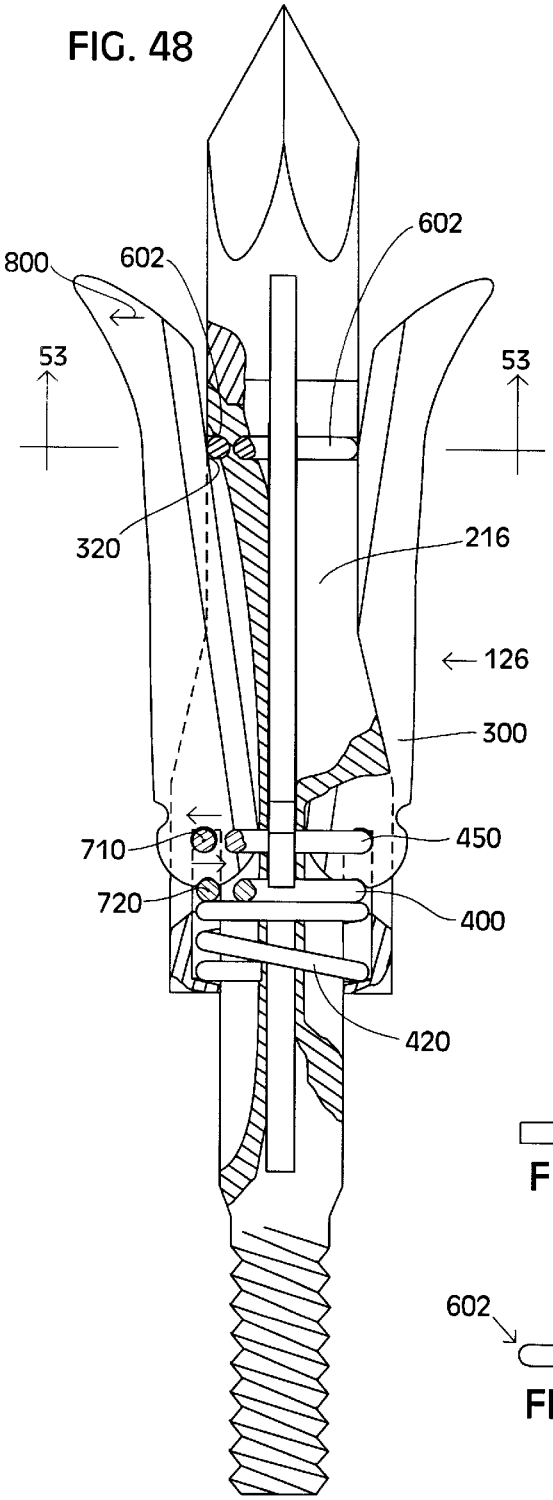
FIG. 49
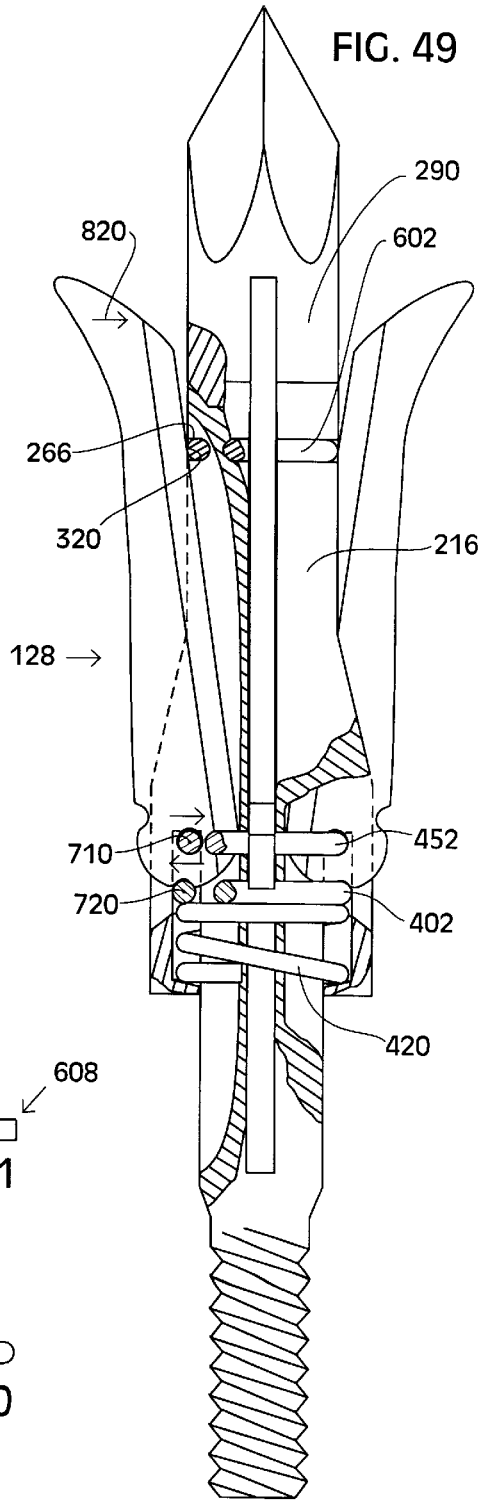
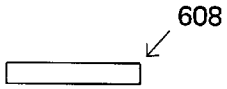
FIG. 51
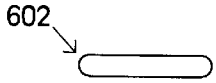
FIG. 50

FIG. 57
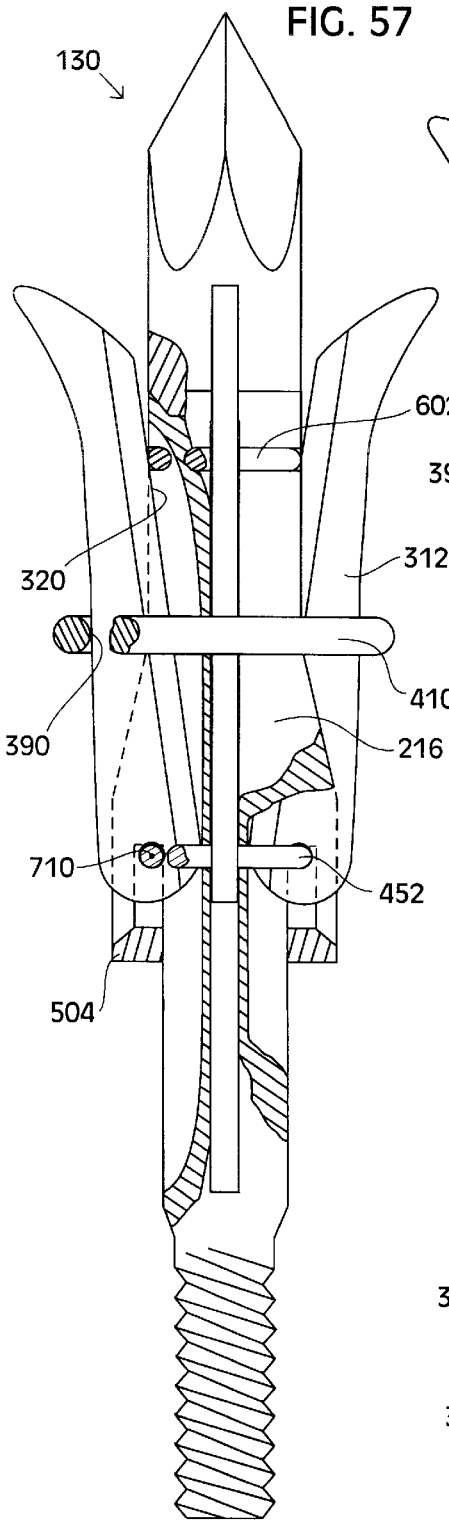
FIG. 58
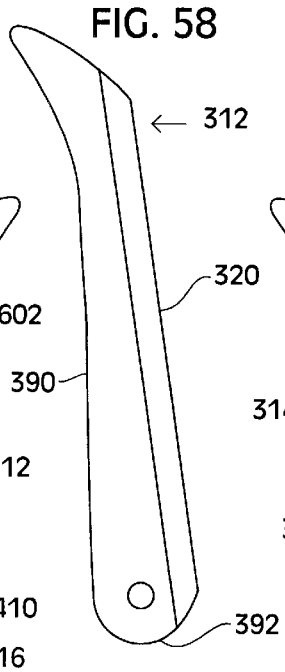
FIG. 59
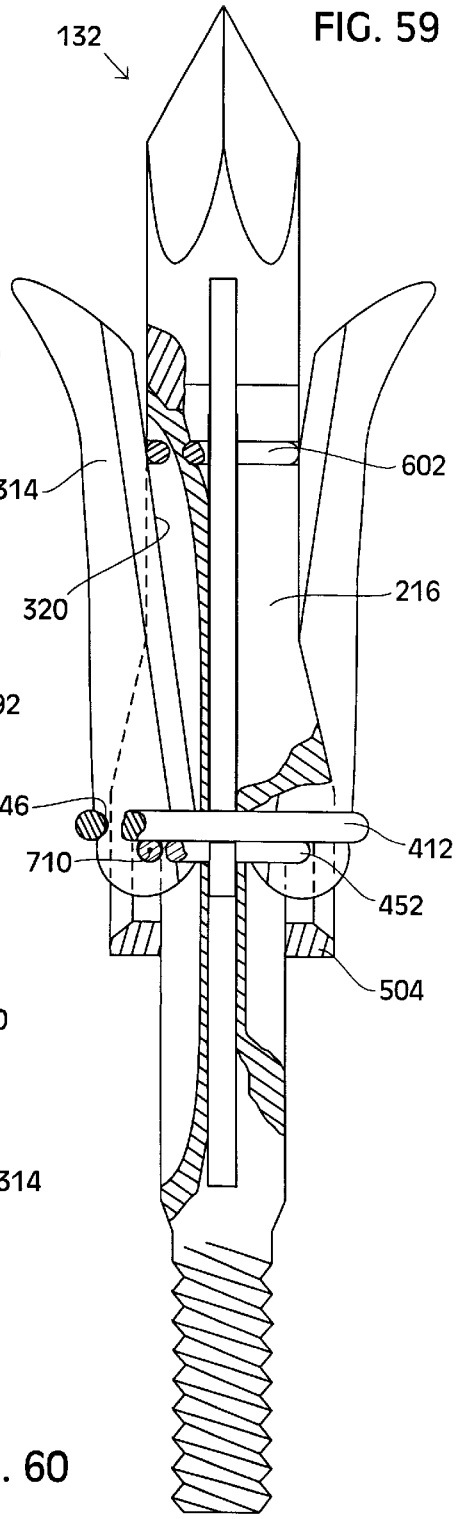
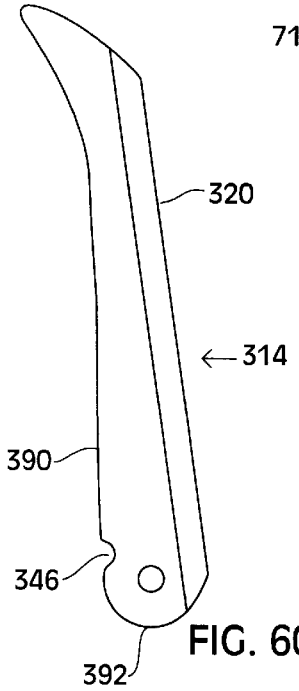
FIG. 60

134
820
602
216
320
300
710
452
340
406
720
504

300
340

136
820
200
320
300
710
452
340
406
720

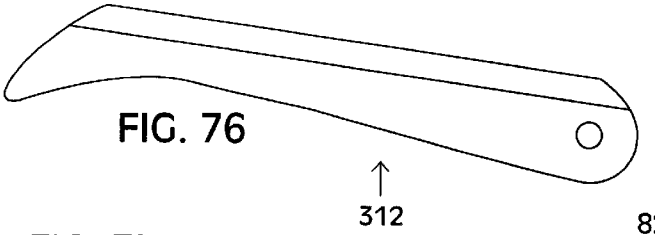
FIG. 76
FIG. 75
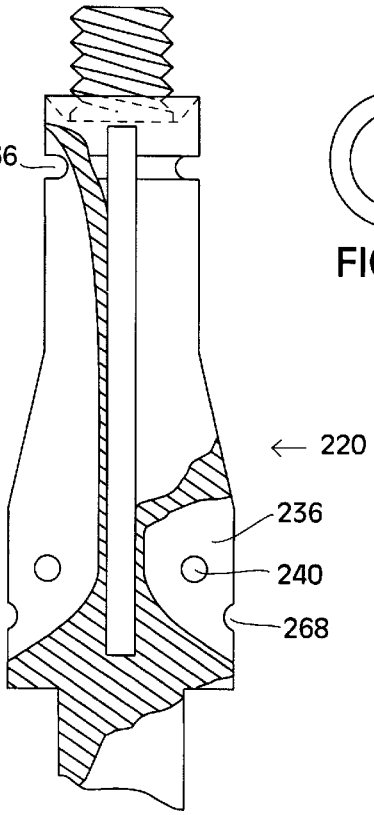
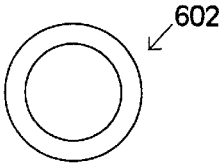
FIG. 77
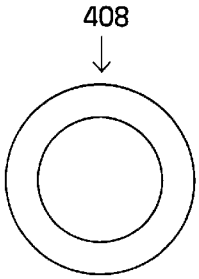
FIG. 78
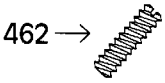
FIG. 80
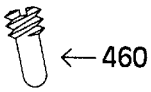
FIG. 79
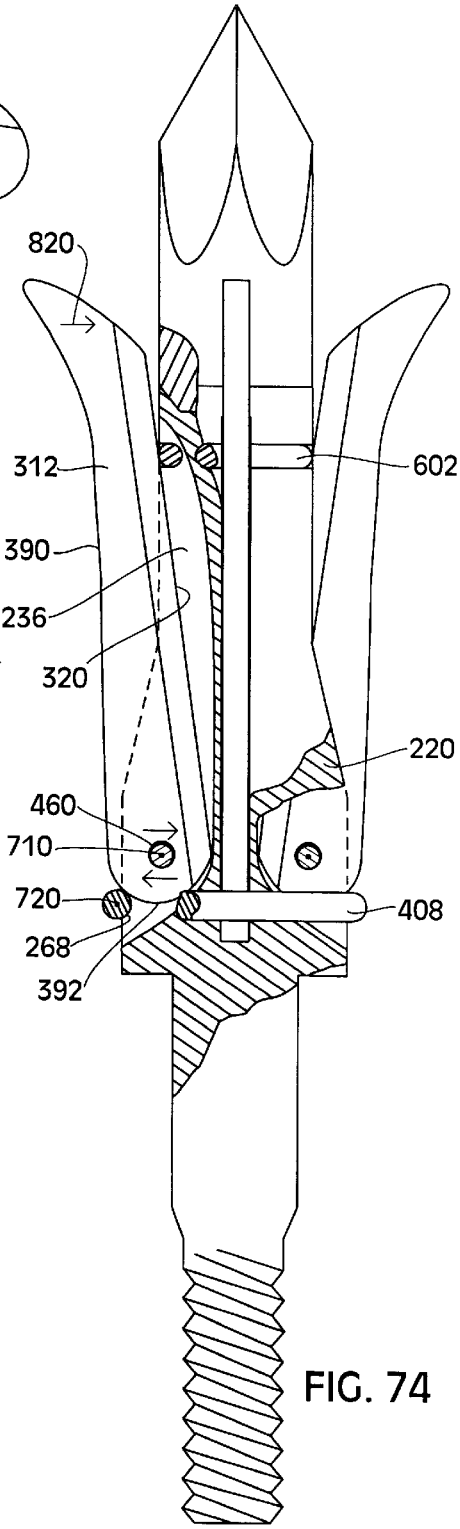
FIG. 74

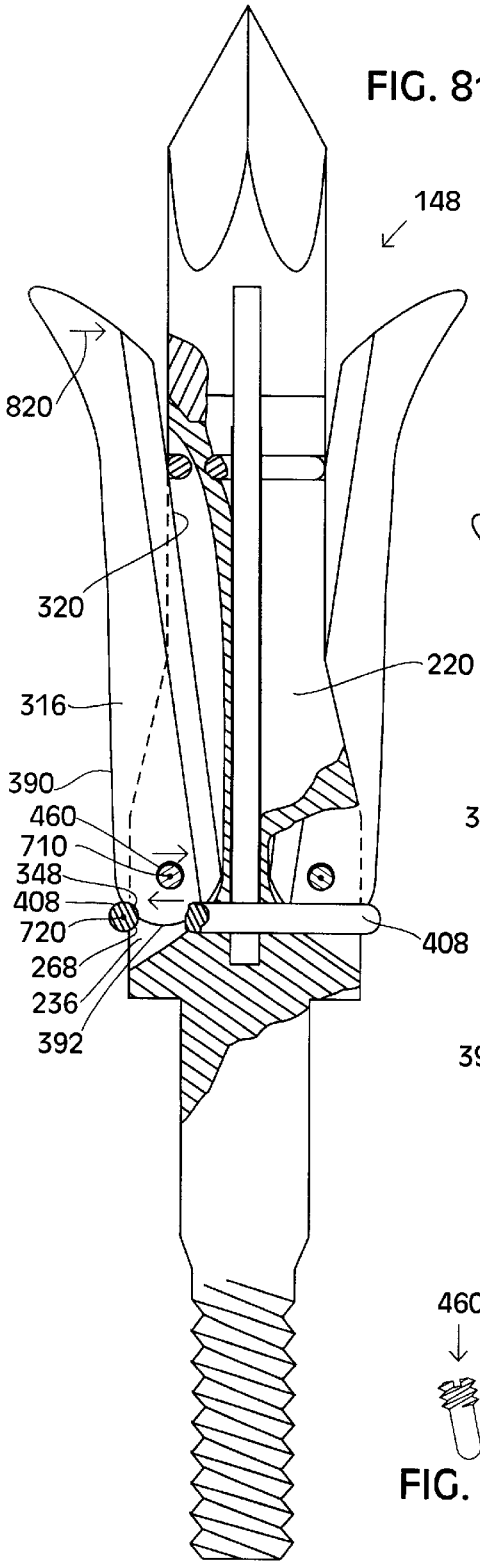
FIG. 81
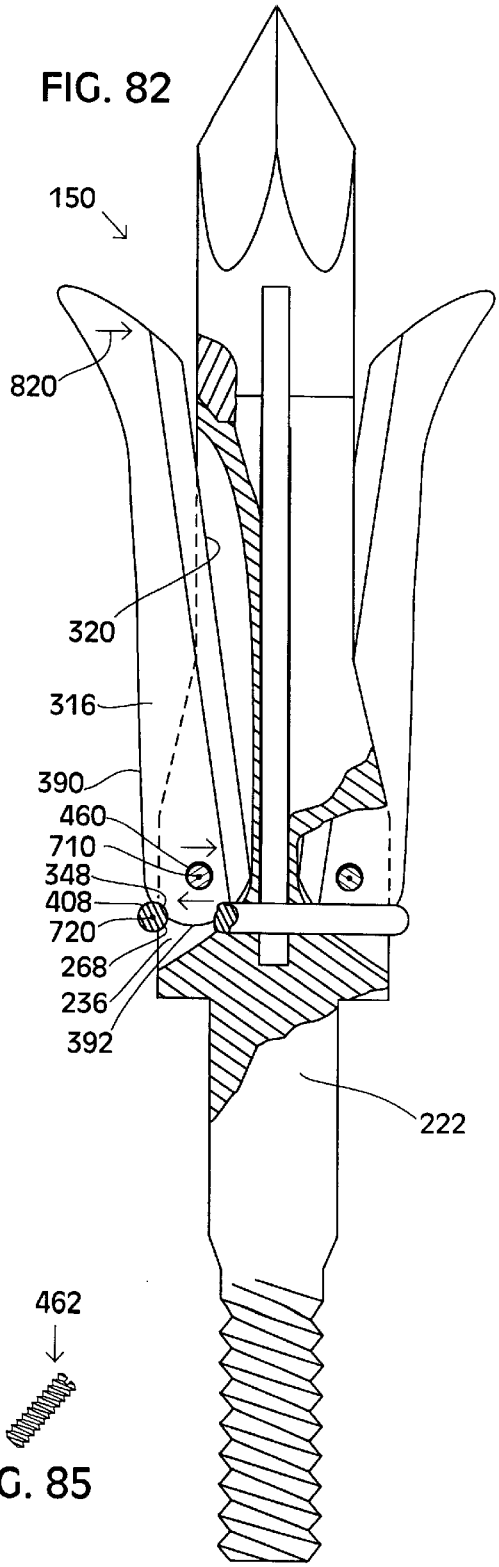
FIG. 82
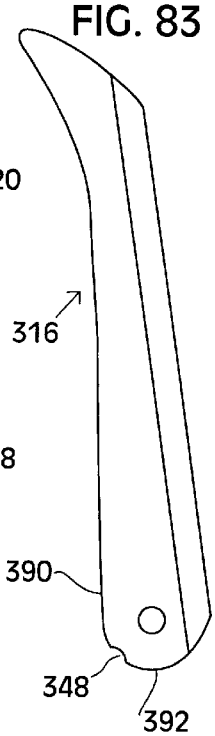
FIG. 83
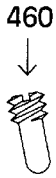
FIG. 84
FIG. 85

152
602
312
320
410
390
460
236
224
460

462

154

602
320
314
346
412
460
236
224

314
390
312
390
346

DULLING PREVENTION FOR SHARP CUTTING EDGE OF BLADE-OPENING ARROWHEAD BLADES WHEN IN A CLOSED IN-FLIGHT POSITION

This application is a Continuation-in-Part of my U.S. patent application Ser. No. 08/834,478, filed Apr. 11, 1997, now abandoned, which is incorporated herein by specific reference.

BACKGROUND

1. Field of the Invention

This invention relates generally to arrowheads having opening blades, and more particularly to blade-opening arrowheads that prevent the razor sharp cutting edges of pivotal blades from becoming dulled or nicked by contact with their corresponding arrowhead bodies when the blades are in a retracted or closed in-flight position.

2. Description of Prior Art

Arrows have long been used for war, hunting and competitive sports. A conventional arrow has a shaft, a nock at one end that receives the bow string, an arrowhead or point that attaches to the opposite end, and fletchings. The fletchings are glued to the shaft near the nock end, and help to stabilize the arrow in flight by causing it to rotate. Arrowheads generally have a pointed forward end, and an opposite threaded shaft end that attaches the arrowhead to the arrow shaft. Arrowheads are also attached to the forward end of arrow shafts by glueing and other methods.

Arrowheads come in a variety of different sizes and configurations depending on their intended use. For example, there are specifically designed arrowheads for competitive target shooting, shooting fish, hunting birds or small game animals, and for hunting big game animals.

Arrowheads used for hunting kill the game animal by cutting vital organs such as the lungs and vascular vessels such as arteries, which causes rapid hemorrhaging and/or suffocation. Quick and humane kills are dependent on accurate shot placement, and upon the amount or volume of the animal tissue that is cut. Hunting arrowheads that cut more tissue are more lethal, and therefore are better. The volume of tissue that is cut is determined by the cutting diameter of the arrowhead, the number of blades it contains, and by the distance the arrowhead penetrates into the animal. The cutting diameter of an arrowhead is determined by how far each cutting blade extends outward from the arrowhead body. The further the blades extend outward the larger the cutting diameter is, and therefore the more cutting potential the arrowhead has.

A common type of arrowhead used in hunting is the fixed-blade arrowhead, which has a pointed tip end used for penetrating, and fixed blades or non-pivotal blades that each have a razor sharp edge for cutting. Conventional fixed-blade arrowheads blades are held in a fixed position on the arrowhead, and most such blades are replaceable. The replaceable blades attach to the arrowhead body in longitudinal grooves called blade slots. The tip of the arrowhead may be separably attachable to the arrowhead body or may be integral with it. Arrowheads for hunting are generally known as broadheads.

Another popular type of arrowhead for hunting is the blade-opening arrowhead. Blade-opening arrowheads are generally known as mechanical broadheads. Blade-opening arrowheads, like conventional fixed-blade arrowheads generally have an elongated arrowhead body, a tip end, and a threaded opposite end. The blades of blade-opening arrowheads have an attachment end which attaches the blades to the arrowhead body by a pivot pin, so that the blades can pivot or rotate in a plane between a closed position and an open position. The blades of blade-opening arrowheads are also received in blade slots, which are machined or formed into the side of the arrowhead body. When the pivotal blades of blade-opening arrowheads are retracted or folded into the closed position, a substantial majority of each blade is generally housed within its corresponding blade slot. This feature gives blade-opening arrowheads the ability to attain significantly increased aerodynamic performance over fixed-blade arrowheads, due to the significantly decreased exposure the retracted blades have with the air when the arrow is rotating while in flight. Such increased aerodynamic performance results in the desirable features of: faster shooting arrows, flatter arrow trajectories, increased penetration energy and enhanced repeatability of accuracy, while also providing a wide diameter cut in the game animal when the razor sharp blades open at impact with the animal.

To hold the blades of blade-opening arrowheads in the retracted position during flight until the arrowhead penetrates the animal, annular retention members such as O-rings are most commonly used. Other commonly known annular retention members are, rubber bands, tight fitting plastic sleeves, tape, heat-shrinkable fitting plastic sleeves, and other wrap materials. Such conventional O-rings and the like are stretched around the outside of the blades when the blades are folded into the closed position, and exert an inward directed resistive force or a closing force against the blades which holds the blades in the retracted position. In addition to conventional O-rings and the like, there are several other blade retention systems know to the art, such as the use of magnetism, springs, leaf springs, friction detents and other frictional mechanisms.

Blade-opening arrowheads also come in a variety of different types and styles. The most common type of blade-opening arrowhead has blades that are pivotally connected to an arrowhead body at a location near the rear end of the arrowhead body. This makes it so that when the blades are folded into the retracted position a leading blade end positioned near the tip of the arrowhead protrudes outward from the arrowhead body. The leading blade ends of such blade-opening arrowheads rotate away from the arrowhead body in a rearward direction when penetrating an animal. Particularly, the leading blade ends catch on the animal's surface and serve to lever or rotate the blades into the open position, thus exposing the sharp cutting edges of the blades and cutting the animal. In such blade-opening arrowheads when the blades are folded into the retracted position each blade is rotated toward the arrowhead body in a forward direction and is received within its blade slot so that the section of the blade having the sharpened cutting edge thereon is seated next to the arrowhead body. With this type of blade-opening arrowhead when the blades are in the retracted or in-flight position the sharp blade edges abut against the arrowhead body or arrowhead tip.

It is desirable for the cutting edge of an arrowhead blade to be as sharp as possible so as to maximize the cutting ability of the arrowhead, and to therefore inflict the quickest killing wound to a game animal. It is also desirable for the cutting edge of an arrowhead blade to be as sharp as possible so as to maximize arrow penetration through the animal so that an easily distinguishable blood trail is created and recovery of the game animal is enhanced.

Arrowhead blade steel is hardened in a heat treating process before the fine razor cutting edge is ground on the blade edge. The more the steel is hardened the sharper a cutting edge the blade will be able to hold or have, but also the brittler the blade becomes. Arrowhead blade steel is generally hardened so as to maximize the sharpness of the blade edge but to yet keep the main section of the blade from becoming so brittle that it breaks or shears at target impact. A truly razor sharp virgin cutting edge has a very narrow angle between opposing blade edge sides or grind bevels, which are produced from the sharpening processes of grinding and/or honing, and therefore the thickness of steel near the cutting edge is very thin. The hardness necessary for arrowhead blade steel to produce an optimally sharp cutting edge while preventing brittleness breaking of the main arrowhead blade section generally is such that the thin section of steel at the very cutting edge is brittle enough or delicate enough to be easily damaged. This is especially evident when the fine cutting edge contacts relatively hard substances such as aluminum, steel or composites.

A major problem associated with blade-opening arrowheads of the type whose blades are retracted next to the arrowhead body such that the sharp cutting blade edges abut against the arrowhead body or arrowhead tip, is that each delicate razor blade edge gets damaged where it contacts the arrowhead body or arrowhead tip. This damage generally nicks the cutting edge or flattens the pointed angle of the discrete cutting edge to a dull blunt, which inhibits the arrowheads ability to cut and therefore decreases its lethality. To compound this problem the inward directed closing force exerted by conventional O-rings and the like against the outside edges of the blades when the blades are in the closed or in-flight position, forces the blades against the arrowhead body of conventional blade-opening arrowheads such that the delicate cutting edges are further pressed into the arrowhead body or tip and therefore are damaged or dulled even more so. Also, when an arrow is shot from a bow the pivotal blades experience a high impulse acceleration when the arrow is first released from the bow, which generates a opening force that acts upon the blades. This phenomena can slightly open the blades just enough to break the contact of the cutting edges with the arrowhead body or arrowhead tip, such that as the arrow begins to decelerate in its downrange flight the blades are slapped back into their closed position by the deceleration causing a closing force upon the blades. This slapping effect magnifies the dulling damage delivered to cutting blade edges of conventional mechanical broadheads.

It is apparent that there is a need for a blade-opening arrowhead that maintains a pivotal blade in a closed in-flight position in such a manner so as to not damage or dull the razor sharp cutting edge of the blade from contact of the cutting edge with the arrowhead body or arrowhead tip.

SUMMARY OF THE INVENTION

It is an object of the present invention to provide a blade-opening arrowhead that maintains a pivotal blade in a retracted or closed in-flight position in such a manner so as to not damage or dull the cutting edge of the blade when the pivotal blade is in the retracted or closed in-flight position.

It is another object of the present invention to provide a blade-opening arrowhead that maintains a pivotal blade in a retracted or closed in-flight position in such a manner so as to prevent the cutting edge of the blade from abutting against a substance when the pivotal blade is in the retracted or closed in-flight position.

It is another object of the present invention to provide a blade-opening arrowhead that maintains a pivotal blade in a retracted or closed in-flight position in such a manner so as to not damage or dull the cutting edge of the blade from contact of the cutting edge with the arrowhead body or arrowhead tip when the pivotal blade is in the retracted or closed in-flight position.

It is another object of the present invention to provide a blade-opening arrowhead that maintains a pivotal blade in a retracted or closed in-flight position in such a manner so as to prevent the cutting edge of the blade from abutting against the arrowhead body or arrowhead tip when the pivotal blade is in the retracted or closed in-flight position.

It is another object of the present invention to provide a blade-opening arrowhead that maintains a pivotal blade in a retracted or closed in-flight position in such a manner so as to decrease the force with which the cutting edge of the blade is forced or touched against the arrowhead body, arrowhead tip or other substance when the pivotal blade is in the retracted or closed in-flight position.

It is further another object of the present invention to provide a blade-opening arrowhead that maintains a pivotal blade in a retracted or closed in-flight position in such a manner so as to cause the cutting edge of the blade to abut against a spacer element when the pivotal blade is in the retracted or closed in-flight position.

It is yet further another object of the present invention to provide a blade-opening arrowhead that maintains a pivotal blade in a retracted or closed in-flight position in such a manner so as to cause the cutting edge of the blade to abut against a non dulling resilient element such as a rubber O-ring or elastic band when the pivotal blade is in the retracted or closed in-flight position.

It is still further another object of the present invention to provide a blade-opening arrowhead that maintains a pivotal blade in a retracted or closed in-flight position in such a manner so as to abut the inner edge of the blade against a substance without the very discrete cutting edge thereof contacting a substance when the pivotal blade is in the retracted or closed in-flight position.

It is still further another object of the present invention to provide a blade-opening arrowhead that maintains a pivotal blade in a retracted or closed in-flight position in such a manner so as to not damage or dull the cutting edge of the blade by exertion of an urging force so as to cause the blade to rotate in a direction when in the retracted or closed in-flight position.

The foregoing objects and advantages and other objects and advantages of the present invention are accomplished with hunting arrowheads that attach to the forward end of an arrow shaft, where a plurality of blades are pivotally connected to an arrowhead body. The blades freely rotate from an in-flight retracted position to an open position when the arrowhead penetrates an object, or when acted upon by a sufficient opening force. When the blades are in the in-flight retracted position their razor sharp cutting edges are protected from being dulled or damaged, so as to provide a more lethal arrowhead.

Such a blade-opening arrowhead according to one preferred embodiment of this invention has a notch formed in the attachment end of each pivotal blade, a compressible annular spring and an annular ring attached to the arrowhead body, such that when the blades are attached to the arrowhead body and positioned in the retracted position the spring urges the annular ring into engagement with the notches so as to cause the forward end or leading levering end of each blade to be rotated in an outward direction away from the arrowhead body. The blades are rotated outwardly until an outer side of the notch abuts against the annular ring. This abutment with the annular ring limits or stops the blades rotation when in the retracted position, which allows the fine razor cutting edges of the blades to be displaced a distance away from the arrowhead body and to thereby prevent any dulling or edge damage since the cutting edges are held from contacting the arrowhead body when in the closed position.

Another blade-opening arrowhead according to another preferred embodiment of this invention differs from the above described preferred embodiment in that the blades are rotated inwardly toward the arrowhead body when in the retracted position, until the annular ring abuts against an inner notch side so as to also displace the razor cutting edges of the blades a distance away from the arrowhead body when in the retracted position.

Other blade-opening arrowheads according to other preferred embodiments of this invention differ from the above described preferred embodiments in that they do not have an annular spring for urging an annular ring into the notches, but rather have an annular resilient element such as a rubber O-ring that urges itself into engagement against the notches so as to cause the desired rotation of the leading blade ends to be obtained so that the cutting edges are displaced away from the arrowhead body and the cutting edges are prevented from being dulled. Other similar annular resilient element self-urging and self-engaging preferred embodiments of this invention differ from the above described preferred annular resilient element self-urging and self-engaging embodiments in that the attachment ends of each blade does not have a notch formed therein.

Yet other blade-opening arrowhead preferred embodiments according to this invention differ from the above described preferred embodiments in that the cutting edges of the blades abut softly against their corresponding arrowhead bodies when in the retracted position. The urging force causing the blades to rotate into abutment against rotational limiting elements such as the annular ring and annular resilient self-urging and self-engaging elements as according to the above described preferred embodiments, greatly reduces the force with which the cutting edges of the blades are touched against their corresponding arrowhead bodies. This protects the cutting edge of each blade when in the retracted or closed in-flight position from getting damaged or dulled. This is in direct contrast to conventional O-rings and the like which are stretched around the outside of the blades so as to exert an inward directed closing force that gouges the fine cutting edges of the blades into their corresponding arrowhead bodies when in the closed position. Such needless dulling produces an arrowhead with inferior cutting and inferior penetrating qualities.

Still other blade-opening arrowheads according to other preferred embodiments of this invention differ from the above described preferred embodiments in that they have an annular resilient spacer element positioned substantially near the forward end of their corresponding arrowhead bodies so that the edges of the blades can abut against such spacer elements when the blades are in the retracted position. According to some such preferred spacer element embodiments the cutting edges abut against resilient or soft-giving spacer elements, whereas according to other such preferred spacer element embodiments the cutting edges do not abut against the spacer elements when the edges of the blades abut against the spacer elements. The spacer element preferred embodiments as according to this invention prevent the blade cutting edges from becoming dulled, nicked or otherwise damaged when the blades are held in the closed or retracted in-flight position.

The blade-opening arrowheads according to the desired results and scope of this invention are more lethal than prior art conventional blade-opening arrowheads in that they protect the razor cutting blade edges from needless dulling or damage.

As has been shown in the above discussion, the blade-opening arrowheads according to this invention overcome deficiencies inherent in prior art arrowheads.

With the above objects and advantages in view, other objects and advantages of the invention will more readily appear as the nature of the invention is better understood, the invention is comprised in the novel construction, combination and assembly of parts hereinafter more fully described, illustrated, and claimed.

BRIEF DESCRIPTION OF THE DRAWINGS

FIG. 12 is a longitudinal partial cross-sectional view of another blade-opening arrowhead preferred embodiment as according to this invention;

FIG. 13 is an enlarged partially exploded side view of the annular blade ring, annular notch ring and spring as according to the blade-opening arrowhead preferred embodiment of this invention as illustrated in FIG. 12;

FIG. 14 is a side view of a pivotal blade as according to the blade-opening arrowhead preferred embodiment of this invention as illustrated in FIG. 12;

FIG. 15 is a top view of an annular blade ring as according to the blade-opening arrowhead preferred embodiment of this invention as illustrated in FIG. 12;

FIG. 16 is a top view of an annular notch ring as according to the blade-opening arrowhead preferred embodiment of this invention as illustrated in FIG. 12;

FIG. 17 is a longitudinal partial cross-sectional view of another blade-opening arrowhead preferred embodiment as according to this invention;

FIG. 18 is a side view of an arrowhead tip as according to some blade-opening arrowhead preferred embodiments of this invention;

FIG. 19 is a side view of another arrowhead tip as according to some blade-opening arrowhead preferred embodiments of this invention;

FIG. 20 is a side view of another arrowhead tip as according to some blade-opening arrowhead preferred embodiments of this invention;

FIG. 21 is a longitudinal partial cross-sectional view of another blade-opening arrowhead preferred embodiment as according to this invention;

FIG. 22 is a longitudinal partial cross-sectional view of another blade-opening arrowhead preferred embodiment as according to this invention;

FIG. 23 is a side view of a pivotal blade as according to some of the blade-opening arrowhead preferred embodiment of this invention;

FIG. 24 is an enlarged top view of the annular notch rings as according to the blade-opening arrowhead preferred embodiments of this invention as illustrated in FIGS. 21 & 22;

FIG. 25 is a longitudinal partial cross-sectional view of another blade-opening arrowhead preferred embodiment as according to this invention;

FIG. 26 is a longitudinal partial cross-sectional view of the arrowhead body of the blade-opening arrowhead preferred embodiment of this invention as illustrated in FIG. 25;

FIG. 27 is a side view of a fully threaded set screw as according to some of the blade-opening arrowhead preferred embodiments of this invention;

FIG. 28 is a side view of a partially threaded set screw as according to some of the blade-opening arrowhead preferred embodiments of this invention;

FIG. 35 is a longitudinal partial cross-sectional view of another blade-opening arrowhead preferred embodiment as according to this invention;

FIG. 36 is a partial longitudinal cross-sectional view of the arrowhead body as according to the blade-opening arrowhead preferred embodiment of this invention as illustrated in FIG. 35;

FIG. 37 is a top view of the spacer element as according to the blade-opening arrowhead preferred embodiments of this invention as illustrated in FIGS. 35 & 38;

FIG. 38 is a longitudinal partial cross-sectional view of another blade-opening arrowhead preferred embodiment as according to this invention;

FIG. 39 is a partial longitudinal cross-sectional view of the arrowhead body as according to the blade-opening arrowhead preferred embodiment of this invention as illustrated in FIG. 38;

FIG. 40 is a top view of the spacer element as according to the blade-opening arrowhead preferred embodiments of this invention as illustrated in FIGS. 35 & 38;

FIG. 48 is a longitudinal partial cross-sectional view of another blade-opening arrowhead preferred embodiment as according to this invention;

FIG. 49 is a longitudinal partial cross-sectional view of another blade-opening arrowhead preferred embodiment as according to this invention;

FIG. 50 is a side view of a spacer element as according to some of the blade-opening arrowhead preferred embodiments of this invention;

FIG. 51 is a side view of a spacer elastic band as according to some of the blade-opening arrowhead preferred embodiments of this invention;

FIG. 57 is a longitudinal partial cross-sectional view of another blade-opening arrowhead preferred embodiment as according to this invention;

FIG. 58 is a side view of the pivotal blade as according to the blade-opening arrowhead preferred embodiment of this invention as illustrated in FIG. 57;

FIG. 59 is a longitudinal partial cross-sectional view of another blade-opening arrowhead preferred embodiment as according to this invention;

FIG. 60 is a side view of the pivotal blade as according to the blade-opening arrowhead preferred embodiment of this invention as illustrated in FIG. 59;

FIG. 74 is a longitudinal partial cross-sectional view of another blade-opening arrowhead preferred embodiment as according to this invention;

FIG. 75 is a longitudinal partial cross-sectional view of the arrowhead body of the blade-opening arrowhead preferred embodiment of this invention as illustrated in FIG. 74;

FIG. 76 is a side view of the pivotal blade as according to the blade-opening arrowhead preferred embodiment of this invention as illustrated in FIG. 74;

FIG. 77 is a top view of the spacer element as according to the blade-opening arrowhead preferred embodiment of this invention as illustrated in FIG. 74;

FIG. 78 is a top view of retaining annular element as according to the blade-opening arrowhead preferred embodiment of this invention as illustrated in FIG. 74;

FIG. 79 is a side view of a partially threaded set screw as according to some of the blade-opening arrowhead preferred embodiments of this invention;

FIG. 80 is a side view of a fully threaded set screw as according to some of the blade-opening arrowhead preferred embodiments of this invention;

FIG. 81 is a longitudinal partial cross-sectional view of another blade-opening arrowhead preferred embodiment as according to this invention;

FIG. 82 is a longitudinal partial cross-sectional view of another blade-opening arrowhead preferred embodiment as according to this invention;

FIG. 83 is a side view of the pivotal blade as according to the blade-opening arrowhead preferred embodiments of this invention as illustrated in FIGS. 81 & 82;

FIG. 84 is a side view of a partially threaded set screw as according to some of the blade-opening arrowhead preferred embodiments of this invention;

FIG. 85 is a side view of a fully threaded set screw as according to some of the blade-opening arrowhead preferred embodiments of this invention;

DETAILED DESCRIPTION OF THE PREFERRED EMBODIMENTS

Dulling prevention means as according to the desired results and scope of this invention prevent the sharpened cutting edge of a pivotal blade-opening arrowhead blade from being dulled when the blade is selectively held in the retracted position or in an in-flight closed position. Dulling or being dulled is generally meant to refer to any undesired disturbance or damaged to the blade cutting edge that would deter from its sharpness or cutting ability, such as blunting, rounding, flattening, burring or nicking.

Preventing the sharpened cutting edge of a pivotal blade-opening arrowhead blade from being dulled when the blade is selectively held in the retracted position as according to the desired results and scope of this invention is accomplished by a variety of different mechanisms. For example, hover means for preventing the sharp cutting edge of the pivotal blade from abutting into a substance, such as an arrowhead body or arrowhead tip, accomplishes such desired results. Soft contact means for decreasing the force with which the sharp cutting edge is touched against a substance, such as an accompanying arrowhead body, also achieves such desired results. The use of rotational limiting elements and spacer elements yet further provide blade-opening arrowheads that achieve the desired dulling prevention results of this invention.

While a variety of the preferred blade-opening arrowhead embodiments as according to this invention utilize retaining means for selectively holding or retaining the blades in the retracted position, wherein retaining means comprises holding means for engaging an element against a blade edge and bias means for producing an urging force so as to engage the holding means against the blade edge, it is to be understood that the desired results of this invention are attainable with blade-opening arrowheads that utilize any method for selectively holding or retaining the pivotal blades in a retracted or closed position, such as with conventional O-rings and the like which are stretched around the outside of the blades and exert an inward directed closing force against the outside blade edges.

Figures 1, 2, 3, 4, 5:
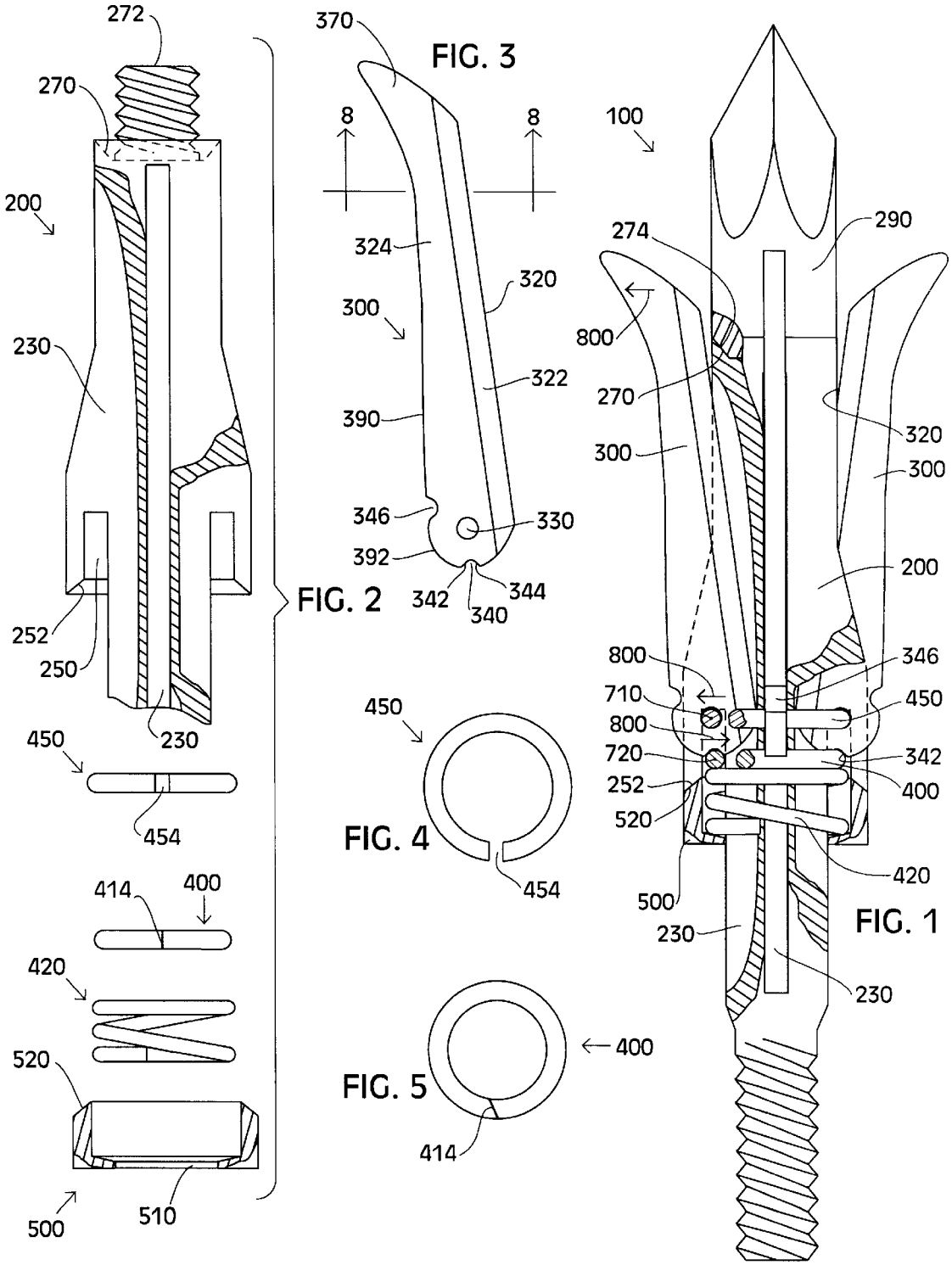
FIG. 1 is a longitudinal partial cross-sectional view of a blade-opening arrowhead preferred embodiment as according to this invention.
FIG. 2 is an exploded longitudinal partial cross-sectional view of the blade-opening arrowhead preferred embodiment as according to this invention as illustrated in FIG. 1.
FIG. 3 is a side view of a pivotal blade as according to the blade-opening arrowhead preferred embodiment of this invention as illustrated in FIG. 1.
FIG. 4 is a top view of an annular blade ring as according to the blade-opening arrowhead preferred embodiment of this invention as illustrated in FIG. 1.
FIG. 5 is a top view of an annular notch ring as according to the blade-opening arrowhead preferred embodiment of this invention as illustrated in FIG. 1.
Figure 9:
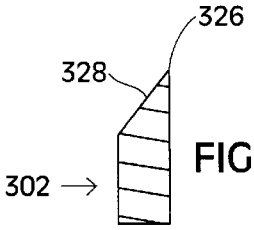
FIG. 9 is a cross-sectional view of another pivotal blade as according to a blade-opening arrowhead preferred embodiment of this invention.
Figure 10:
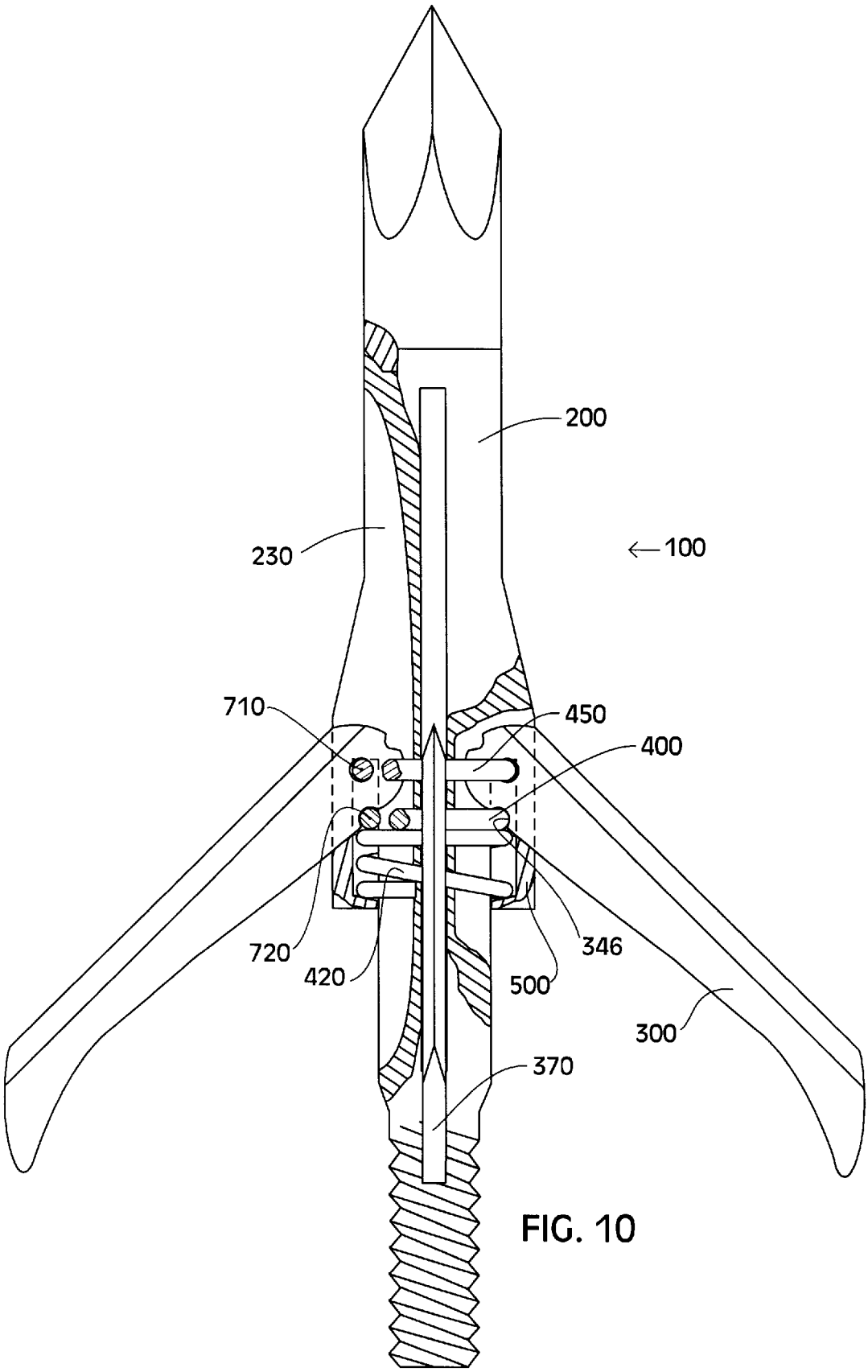
FIG. 10 is another longitudinal partial cross-sectional view of the blade-opening arrowhead preferred embodiment of this invention as illustrated in FIG. 1.

FIGS. 1–10 illustrate a blade-opening arrowhead 100 as according to a preferred embodiment of this invention wherein a plurality of three blades 300—300—300 are pivotally hinged to an arrowhead body 200 so as to be selectively rotatable between a retracted position as illustrated in FIG. 1 and an open position as illustrated in FIG. 10.

Figure 8:
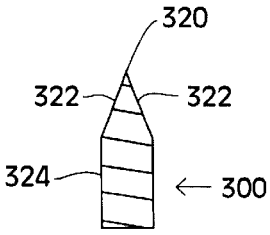
FIG. 8 is a cross-sectional view of the pivotal blade as according to the blade-opening arrowhead preferred embodiment of this invention as illustrated in FIG. 1.
Figure 6:
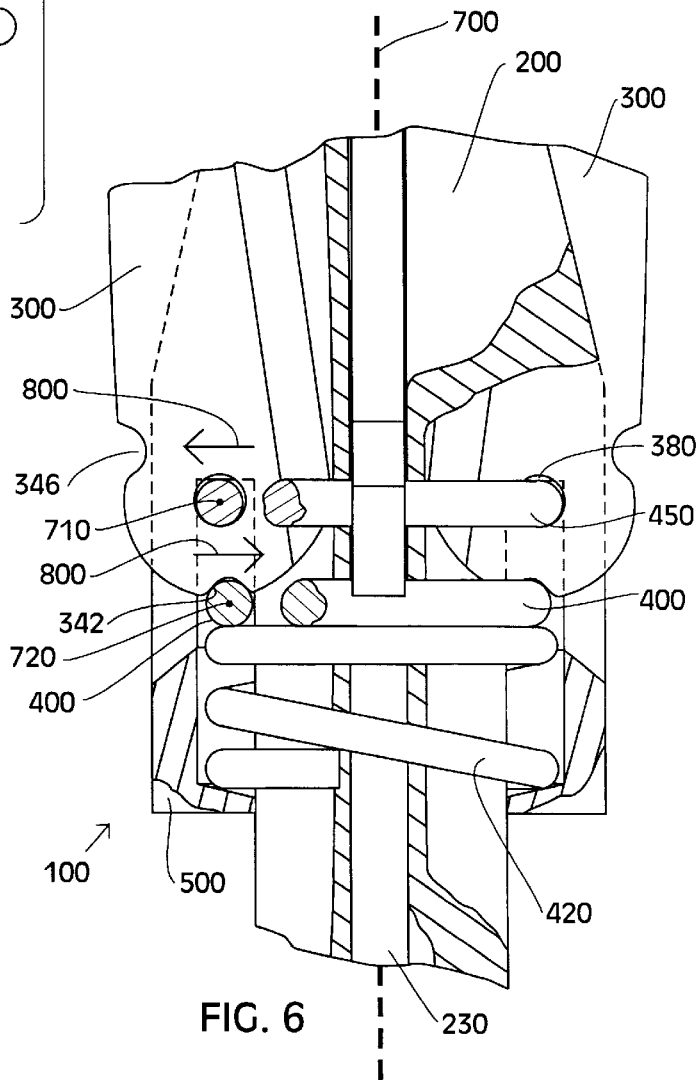
FIG. 6 is an enlarged partially sectioned view of the blade-opening arrowhead preferred embodiment of this invention as illustrated in FIG. 1.

FIGS. 1–5 clearly illustrate the various structural components of arrowhead 100. FIG. 2 illustrates arrowhead body 200 having a plurality of three blade slots 230—230—230, a recessed annular groove 250, a blade stop washer beveled locking flank 252, a tip locking flank 270 and a threaded male stud 272. As illustrated in FIG. 1 a removably attachable tip 290 is threaded onto male stud 272 of arrowhead body 200. Arrowhead tip 290 has a beveled locking flank 274 that matingly locks with or against tip locking flank 270 of arrowhead body 200 as is clearly illustrated in FIG. 1. FIG. 2 yet further illustrates an annular blade hinge ring 450 having a gap 454 for insertion of the plurality of pivotal blades 300—300—300 thereon, an annular notch ring 400 having an ends abutment 414, a compressible annular spring 420, and a blade stop washer 500 having a through hole 510 and a beveled blade abutting surface 520. FIG. 3 illustrates a blade 300 having a leading wing 370 at a first end thereof, a pair of opposing faces or sides 324—324, an outer edge 390, an inner sharpened cutting edge 320 having a pair of grind bevels 322—322 situated on either side thereof as is best seen in FIG. 8, a hinge pin receiving hole 330, a first notch 340 having an inner side 344 and an outer side 342, and a second notch 346. As illustrated in FIG. 6 a gap 380 is formed between blade aperture 330 and hinge pin 450. FIGS. 4 & 5 illustrate top views of annular blade hinge ring 450 and annular notch ring 400 respectively. It is apparent that the abutting ends of ring 400 as depicted by 414 can be welded together so that annular ring 400 is substantially incapable of being expanded to a larger diameter under normal arrowhead use conditions. FIG. 9 illustrates a pivotal blade 302 having a single grind bevel 328 that defines a cutting edge 326 which is in substantially coplanar alignment with a blade face or side of blade 302.

It is apparent that the cutting edges or sharpened sections of blade edges that provide the cutting function of the blade-opening arrowheads as according to this invention may be fabricated or machined in a variety of different designs so as to obtain a cutting objective of an arrowhead. For example it is apparent that the cutting edges of the pivotal blades of this invention may have serrated cutting edge patterns formed thereon.

Figure 7:
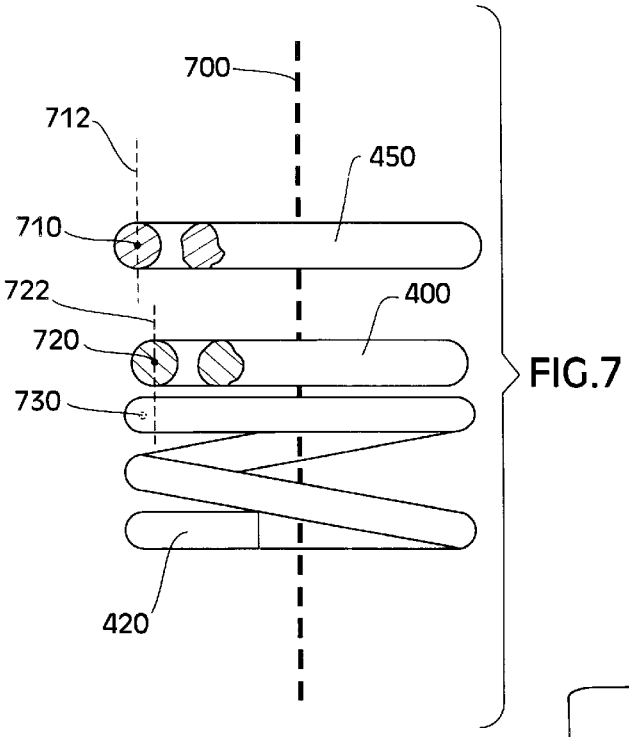
FIG. 7 is an enlarged partially exploded side view of the annular blade ring, annular notch ring and spring as according to the blade-opening arrowhead preferred embodiment of this invention as illustrated in FIG. 1.

As is clearly illustrated in FIGS. 1, 6 & 7 annular hinge ring 450 has a cross-sectional center 710, annular notch ring 400 has a cross-sectional center 720 and compressible spring 420 has a cross-sectional center 730. FIG. 7 illustrates a plane 712 parallel to a central longitudinal axis 700 of arrowhead 100 intersecting cross-sectional center 710 of hinge ring 450 and a plane 722 also parallel to central longitudinal axis 700 of arrowhead 100 intersecting cross-sectional center 710 of annular notch ring 450. The urging force produced from the compression of annular spring 420 is applied to the attachment end or a second blade end 392 of each blade 300 within first notch 340 at a location in-line or collinear with plane 722 in a substantially forward direction when blades 300—300—300 are in the retracted position. This makes it so the urging force is applied to second blade end 392 of each blade 300 at a location spaced apart from plane 712. Particularly, cross-sectional center 720 of notch ring 400 is situated closer to central longitudinal axis 700 than cross-sectional center 710 of hinge ring 450. Therefore, cross-sectional center 720 of notch ring 400 is situated medially of cross-sectional center 710 of hinge ring 450. This makes it so a lever arm is created which generates an outward rotational force 800 to act upon each blade 300 when in the retracted position as is clearly seen in FIGS. 1 & 6. Rotational force 800 causes each blade's leading end to be rotated outward until outer side 342 of notch 340 abuts against the outer side or lateral side of annular ring 400 wherein annular ring 400 serves as a rotational limiting element as according to the rotational limiting elements of this invention. The abutment between outer side 342 of notch 340 and annual ring 400 allows cutting edge 322 of each blade 300 to be displaced a distance away from arrowhead body 200 when blades 300—300—300 are selectively held in the retracted position as is clearly shown in FIG. 1.

Rotational limiting elements as according to this invention serve to abut against the blade edges so as to limit or stop the rotation of the blades when in the retracted position to preferably desirable locations with respect to corresponding arrowhead bodies so that the desired results of dulling prevention as according to this invention is obtained.

The displacement of each blade's cutting edge 320 a distance away from arrowhead body 200 so as to prevent cutting edges 320—320—320 from being dulled when in the retracted position is an example of hover means as according to this invention. It is apparent that rotational limiting elements as according to this invention may comprises the holding means of the retaining means as according to some preferred embodiments of this invention, for example as annular notch ring 400 does.

It is apparent that the distance that cutting edges 320—320—320 are displaced away from arrowhead body 200 when blades 300—300—300 are in the retracted position can be varied by use of different blades having hinge pin apertures 330 and notches 340 situated thereon with different spatial arrangements relative to one another. It is also apparent that the distance that cutting edges 320—320—320 are displaced away from arrowhead body 200 when blades 300—300—300 are in the retracted position can be varied by changing the distance away from the cross-sectional center of the hinge means that the urging force is applied to the second blade ends 392. It is yet further apparent that there are other ways to change or vary the distance that the cutting edges of the blades of the blade-opening arrowheads of this invention are displaced away from their corresponding arrowhead bodies when in the retracted position, such as by the utilization of annular notch rings having different diameters as well as with annular notch rings having different cross-sectional diameters.

Figure 11:
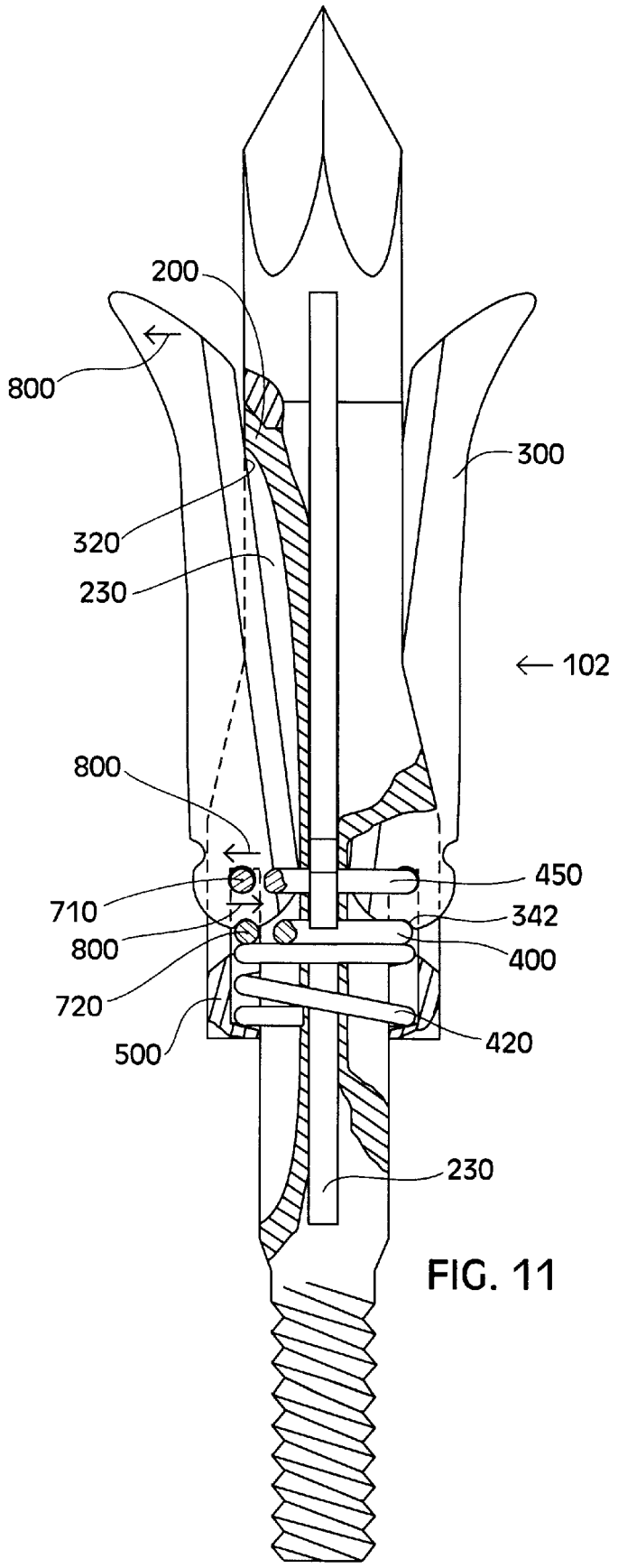
FIG. 11 is a longitudinal partial cross-sectional view of another blade-opening arrowhead preferred embodiment as according to this invention.

FIG. 11 illustrates a blade-opening arrowhead 102 which is similar to preferred embodiment arrowhead 100, except arrowhead 102 has the cutting edge 320 of at least one pivotal blade 300 gently contacting arrowhead body 200 when in the retracted position. Arrowhead 102 illustrates an example of soft contact means as according to this invention, wherein at least one razor cutting edge 320 contacts a substance, such as arrowhead body 200, when in the retracted position in such a manner so as to decrease the force with which cutting edge 320 is touched against arrowhead body 200. This prevents each cutting edge 320 from being dulled when blades 300—300—300 are in the retracted position. The reduction of the force with which cutting edge 320 is touched against arrowhead body 200 is accomplished by rotational limiting element 400 absorbing the majority of rotational force 800 when outer side 342 of notch 340 rotates thereagainst. The reduction of the force with which cutting edge 320 is touched against arrowhead body 200 is a desired result as according to the dulling prevention means, and soft contact means of this invention.

Soft contact means as according to this invention provide blade-opening arrowheads whose cutting edges touch or contact their corresponding arrowhead bodies or other structure with significantly less pressure or force than blade-opening arrowheads utilizing conventional O-rings and the like, wherein the entire magnitude of the closing force produced from outward stretched conventional O-rings forces the fine cutting edges of the blades into maximum engougment with their corresponding arrowhead bodies and thus needlessly and undesirably dulls such cutting edges.

It is apparent that as according to the desired results and scope of the dulling prevention means of this invention that the blade-opening arrowheads of this invention may have cutting blade edges softly contacting corresponding arrowhead bodies or other equivalent structure such as corresponding arrowhead tips. It is also apparent that as according to the desired results and scope of the dulling prevention means of this invention that the cutting edges of the pivotal blades of the blade-opening arrowheads of this invention may not contact their corresponding arrowhead bodies.

The preferred embodiments of this invention as illustrated in FIGS. 1–11 utilize retaining means for selectively retaining pivotal blades 300—300—300 in the retracted position wherein an urging force is produced from the bias means so as to engage holding means against the edge of each blade. In particular spring 420 comprises the bias means and annular ring 400 comprises the holding means. As according to the retaining means of which some of the various embodiments of this invention utilize for blade retention, it is apparent that a single structural entity may produce the urging force so as to urge itself into engagement against the blade edge or edges and thus provide both the functions of the bias means and the holding means when selectively holding a pivotal blade in the retracted position.

It is apparent that the bias means for producing an urging force to act upon the blades so as to protect the fine cutting edges from being dulled may or may not comprise the bias means of the retaining means for selectively holding the pivotal blades in the retracted position as is according to some preferred embodiments of this invention. It is also apparent that the same structural entity or entities performing the bias means, holding means and/or retaining means functions may also provide any of the various dulling prevention desired results or visa versa as is according to the scope of this invention.

FIGS. 12–16 illustrate a blade-opening arrowhead 104 as according to another preferred embodiment of this invention. Arrowhead 104 is similar to arrowheads 100 and 102 except that arrowhead 104 has an annular hinge ring 452 which has a narrower diameter than annular hinge ring 450, and an annular notch ring 402 which has a wider diameter than annular notch ring 400, such that a plane 724 parallel to central longitudinal axis 700 of arrowhead 104 intersecting cross-sectional center 720 of notch ring 402 is situated laterally of cross-sectional center 710 of hinge ring 452 as is clearly illustrated in FIG. 13. The urging force produced from the compression of annular spring 420 is applied to each blade 300 within first notch 340 at a location in-line or collinear with plane 724 in a substantially forward direction when blades 300—300—300 are in the retracted position. This makes it so the urging force is applied to second blade end 392 of each blade 300 at a location spaced apart from plane 714. Furthermore, this makes it so a lever arm is created which generates an inward rotational force 820 to act upon each blade 300 when in the retracted position as is clearly seen in FIG. 12. Rotational force 820 causes each blade's leading end to be rotated inward until inner side 344 of notch 340 abuts against the inner side of annular ring 402 as is also illustrated in FIG. 12 wherein annular ring 402 serves as a rotational limiting element as according to the rotational limiting elements of this invention. The abutment between inner side 344 of notch 340 and annual ring 402 allows cutting edge 320 of each blade 300 to be displaced a distance away from arrowhead body 200 when blades 300—300—300 are selectively held in the retracted position as is clearly shown in FIG. 12. The displacement of each blade's cutting edge 320 a distance away from arrowhead body 200 so as to prevent cutting edges 320—320—320 from being dulled when in the retracted position is another example of hover means as according to this invention.

It is apparent that blade-opening arrowheads having the urging force applied to the second blade end of each blade at a location that is not spaced apart from a plane parallel to the corresponding arrowhead central longitudinal axis which also intersects the cross-sectional center of the hinge means can be obtained so as to produce the desired dulling prevention results as according to an objective of the blade-opening arrowheads of this invention.

FIGS. 17–20 illustrate a blade-opening arrowhead 106 as according to another preferred embodiment of this invention, an arrowhead tip 292, an arrowhead tip 294, and arrowhead tip 290. Arrowhead 106 is similar to arrowheads 100 and 102 except that arrowhead 106 has an arrowhead body 202 with an arrowhead tip 296 integrally formed therewith.

As illustrated in FIGS. 17–20 it is apparent that the blade-opening arrowheads as according to this invention may have any type of arrowhead tip, whether removably attachable or integral therewith. It is also apparent that the manner of attaching a tip to an arrowhead body or the type of tip thereof is of relatively minor importance to this invention. It is apparent that removably attachable arrowhead tips having small replaceable cutting blades removably attachable therewith may be used in combination with the blade-opening arrowheads of this invention, or that arrowhead tips having cutting blades or razor sharp cutting edges whether replaceable or integral therewith are usable with the blade-opening arrowheads of this invention.

Referring again to FIGS. 17–20 arrowhead tip 294 as illustrated in FIG. 20 has a threaded male stud 280 that removably attaches tip 294 to a corresponding arrowhead body. Arrowhead tip 292 has a threaded female cavity 276 and a rear end flat 278 which abuts against a corresponding arrowhead body or other corresponding integral arrowhead structure as will be disclosed herein. Arrowhead tip 290 as used with arrowheads 100–104 as previously described above and as used with other preferred blade-opening arrowhead embodiments of this invention more securely locks or attaches tip 290 to an accompanying arrowhead body than tip 278 does, specifically because the angular orientation of locking bevel 274 of tip 290 and locking bevel 274 of an accompanying arrowhead body provide more surface area contact between the respective beveled parts which enhances the strength of the arrowhead.

According to some preferred embodiments of this invention the angular offset, between tip locking bevel 270 of a corresponding arrowhead body and a plane perpendicular to the central longitudinal axis of the corresponding arrowhead body which is also coplanar with a plane intersecting the juncture of a threaded male tip receiving stud and the main rearwardly located portion of the arrowhead body, is 30 degrees. Such an arrowhead tip and arrowhead body combination is illustrated for example in FIG. 1.

FIGS. 21–24 illustrate a blade-opening arrowhead 108, and a blade-opening arrowhead 110, as according to other preferred embodiments of this invention. Arrowheads 108 & 110 are similar to arrowhead 100 except that arrowheads 108 & 110 have an arrowhead body 204 that has a narrower diameter upper body section 226 with an accompanying narrower diameter tip therewith. Arrowhead 110 utilizes annular notch ring 400 whereas arrowhead 108 utilizes a wider diameter annular notch ring 404 as is illustrated in FIG. 24. Since notch ring 404 is of a different diameter than notch ring 400 the location the urging force is applied to the second end of each blade 300 on arrowhead 108 is different than the location the urging force is applied to the second end of each blade 300 on arrowhead 110. This controls or limits the rotation of each corresponding blade 300 of arrowhead 110 outwardly when in the retracted position, to a displaced distance away from corresponding arrowhead body 204 that is different than the displaced distance that annular ring 400 displaces each blade 300 away from corresponding arrowhead body 204 of arrowhead 108. Also, the rotational limiting elements of annular ring 400 and annular ring 404 are accordingly situated upon arrowhead bodies 204—204 in different three-dimensional spatial relations with respect to the corresponding hinge means when mounted thereto, so as to also act in controlling or limiting the rotation of each corresponding blade 300 when in the retracted position to different displaced distances away from corresponding arrowhead bodies 204—204. This is readily apparent from FIGS. 21 & 22 wherein each blade 300 of arrowhead 110 is displaced a distance substantially further away from corresponding arrowhead body 204 than the distance each blade 300 is displaced away from corresponding arrowhead body 204 of arrowhead 108.

As is clearly illustrated in FIGS. 21 & 1 it is apparent that blade-opening arrowheads as according to this invention having different diameter forward or upper arrowhead body sections such as arrowhead 108 as depicted in FIG. 21 when compared with arrowhead 100 as in FIG. 1, may use the same pivotal blade 300 to displace the cutting edge 320 of each blade 300 substantially equidistantly away from their corresponding arrowhead bodies by use of annular notch rings or equivalents which have different physical dimensions such as different diameters.

FIGS. 25–28 illustrate a blade-opening arrowhead 112, a partially threaded set screw 460 as shown in FIG. 28, and a fully threaded set screw 462 as shown in FIG. 27 as according to other preferred embodiments of this invention. Arrowhead 112 is similar to arrowhead 108 except that arrowhead 112 utilizes straight hinge pins or threaded set screws 460 or 462 for hinge means. Arrowhead 112 has an arrowhead body 206 that has a plurality of blade slots 232—232—232 and a set screw receiving hole 240 formed therein for each pivotal blade 300. It is apparent that various types of hinge pins and the like may be used with the blade-opening arrowheads as according to this invention so as to achieve the hinge means performance objectives thereof.

Figures 29, 30, 31, 32, 33, 34:
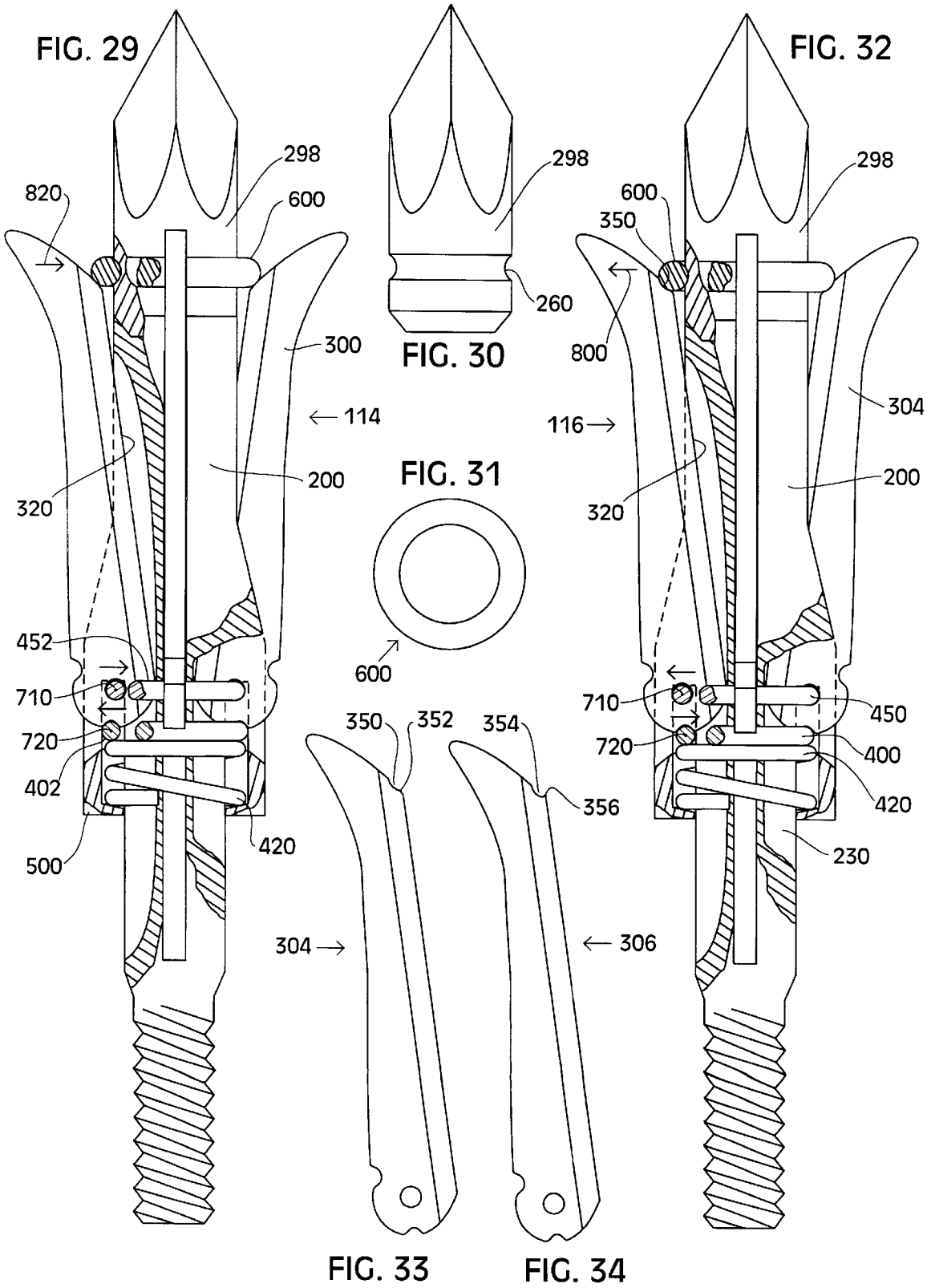
FIG. 29 is a longitudinal partial cross-sectional view of another blade-opening arrowhead preferred embodiment as according to this invention.
FIG. 30 is a side view of another blade-opening arrowhead tip as according to the preferred embodiments of this invention as illustrated in FIGS. 29 & 32.
FIG. 31 is a top view of the spacer element as according to the blade-opening arrowhead preferred embodiments of this invention as illustrated in FIGS. 29 & 32.
FIG. 32 is a longitudinal partial cross-sectional view of another blade-opening arrowhead preferred embodiment as according to this invention.
FIG. 33 is a side view of the pivotal blade as according to the blade-opening arrowhead preferred embodiment of this invention as illustrated in FIG. 32.
FIG. 34 is a side view of another pivotal blade as according some of the blade-opening arrowhead preferred embodiments of this invention.

FIGS. 29–34 illustrate a blade-opening arrowhead 114, and a blade-opening arrowhead 116 as according to other preferred embodiments of this invention. Arrowhead 114 as illustrated in FIG. 29 is similar to arrowhead 104 as illustrated in FIG. 12, except arrowhead 114 has an externally exposed annular groove 260 formed in an arrowhead tip 298 for removably receiving a spacer element 600 therein. Spacer element 600 as illustrated in FIG. 29 abuts against the blade edge of each blade 300 at the first ends thereof and substantially does not abut with grind bevels 322—322 nor with cutting edge 320 of each blade 300 when blades 300—300—300 are in the retracted position. Spacer element 600 serves to abut against the blade edges of each blade 300 so as to prevent cutting edge 320 of each blade 300 from contacting arrowhead body 200. This prevents cutting edges 320—320—320 from being dulled when blades 300—300—300 are in the retracted position as is according to the desired results of this invention. Arrowhead 116 as illustrated in FIG. 32 is similar to arrowhead 114 except that arrowhead 116 has a plurality of three blades 304—304—304 each having a notch 350 and a catch lip 352 located at the first or leading blade ends thereof. Arrowhead 116 also differs from arrowhead 114 in that arrowhead 116 has outward rotational force 800 acting upon each blade 304 when in the retracted position whereas arrowhead 114 has inward rotational force 820 acting upon each blade 300 when in the retracted position. FIG. 34 illustrates a pivotal blade 306 having a notch 354 and a catch lip 356. Catch lip 356 is more pronounced than catch lip 352 of blade 304 and therefore provides a higher frictional grip with spacer element 600 when mounted to an accompanying arrowhead.

It is apparent that spacer element 600 and recessed external annular groove 260 or an equivalent could be used with a blade-opening arrowhead that utilizes a conventional O-ring stretched around the outside of the blades to exert an inwardly directed closing force thereagainst for blade retention so as to accomplish the desired results of the hover means and dulling prevention objectives of the blade-opening arrowheads of this invention.

Spacer elements as according to this invention abut against the blade edges so as to prevent the sharp cutting edges from contacting corresponding arrowhead bodies, or equivalents, so that the cutting edges are not dulled as is according to the desired results of this invention. Spacer elements may abut against the discrete very razor cutting edge, and/or may abut against a grind bevel or grind bevels of a sharpened edge, or may abut against the blade edge that extends peripherally about the blade in other locations than the sharpened edge section. While the spacer elements as according to some of the preferred embodiments of this invention are preferably annular resilient elements such as rubber O-rings, that abut with all the blades of a corresponding arrowhead, it is to be understood that the spacer elements as according to this invention may be formed in shapes other than annularly, so that a spacer element acts upon less than the full plurality of blades—as for example, where only one spacer element services one blade.

The spacer elements as according to this invention may comprise sections of corresponding arrowhead bodies whether removably attachable or integrally formed therewith or may be separably attachable non-arrowhead body elements such as annular elastic bands or annular springs, and annular rings such as a metal annular ring or a rubber O-ring. The spacer elements as according to this invention can be fabricated from rubber, plastics, Teflon, composites, other organic polymeric materials, metals, waxes, pastes, adhesives and the like, and any other element or elements that serve to preform the desired results and objectives of the spacer elements as according to this invention.

It is apparent that the spacer elements as according to the desired dulling prevention results of the blade-opening arrowheads as according to this invention may be combined or used in combination of various degrees with other elements of the disclosed preferred embodiments of this invention as disclosed within this specification as well as with other preferred embodiments of this invention not disclosed within this specification.

FIGS. 35–40 illustrate a blade-opening arrowhead 118, and a blade-opening arrowhead 120 as according to other preferred embodiments of this invention. Both arrowheads 118 & 120 utilize a spacer element 602 to prevent cutting edges 320 of each corresponding blade 300 from becoming dulled when in the retracted position. Arrowhead 120 has an arrowhead body 210 with a neck 282 as is illustrated in FIG. 39 situated at the base of the forwardly protruding threaded stud which receives an arrowhead tip 292 thereon. Annular spacer 602 is generally received about neck 282 before tip 292 is threadably attached thereto. Arrowhead 118 has an arrowhead body 208 with an externally exposed annular groove 262 formed thereabout as is illustrated in FIG. 36 so that annular spacer 602 is slidably positioned therein by being slid along the arrowhead tip and arrowhead body in a rearward direction. As is illustrated in FIGS. 35 & 38 spacers 602—602 do not abut cutting edge 320 of each blade 300 when in the retracted position. It is apparent that spacer elements as according to this invention may provide the desired results of hover means as according to this invention, in that the sharp cutting edges are prevented from abutting into a substance such as arrowhead bodies 208 & 210 when the blades are in the retracted position.

Positioning means as according to this invention limit the displacement of spacer elements when mounted to corresponding arrowhead bodies so as to be enabled to strategically displace the cutting edge or blade edges a distance away from corresponding arrowhead bodies when the blades are in the retracted position so that the cutting edges are not dulled. Externally exposed annular grooves 262 & 260 as in FIGS. 36 & 30 respectively are examples of positioning means as according to this invention.

Figures 41, 42, 43, 44, 45, 46, 47:
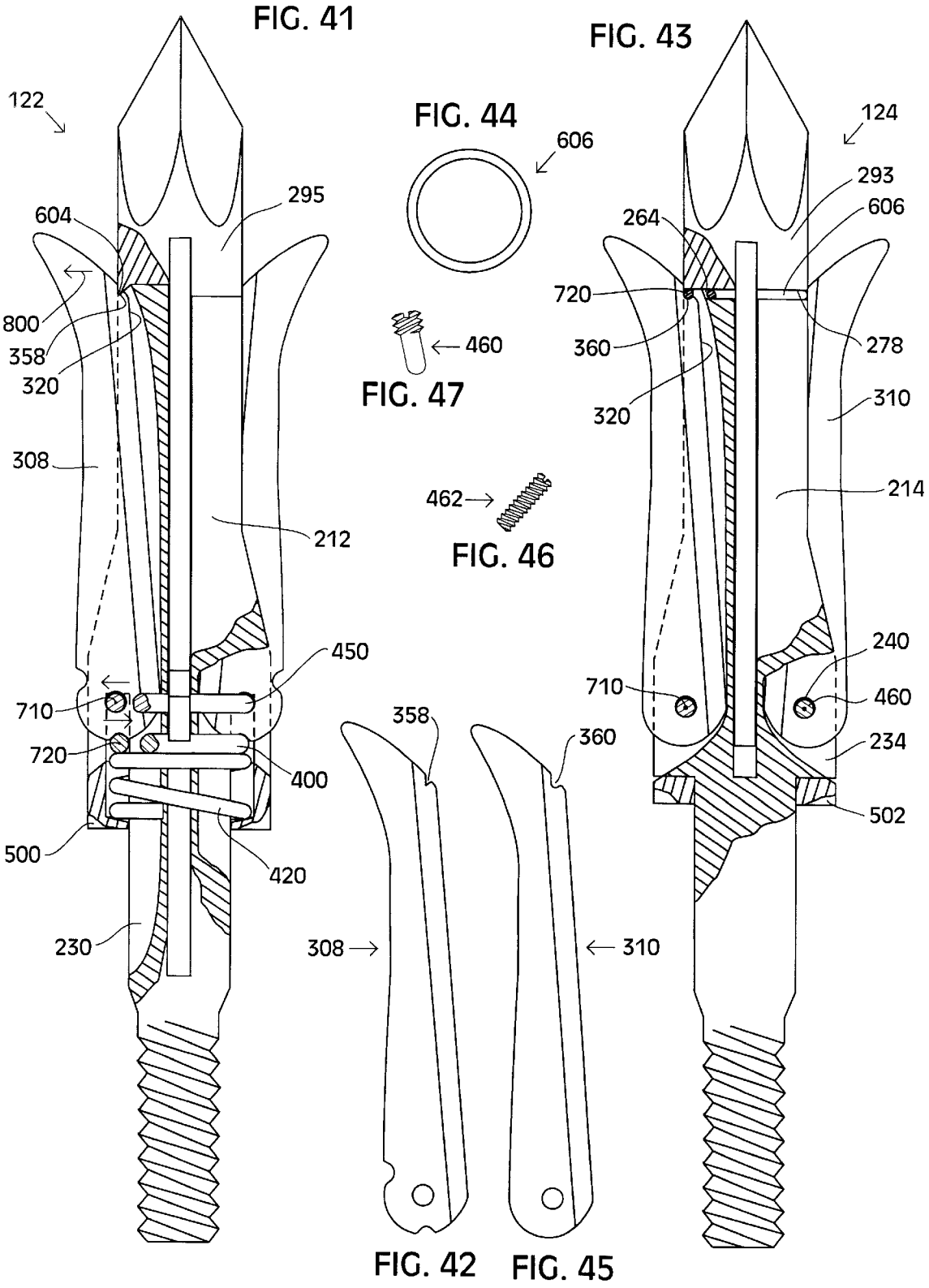
FIG. 41 is a longitudinal partial cross-sectional view of another blade-opening arrowhead preferred embodiment as according to this invention.
FIG. 42 is a side view of the pivotal blade as according to the blade-opening arrowhead preferred embodiment of this invention as illustrated in FIG. 41.
FIG. 43 is a longitudinal partial cross-sectional view of another blade-opening arrowhead preferred embodiment as according to this invention.
FIG. 44 is a top view of the spacer element as according to the blade-opening arrowhead preferred embodiment of this invention as illustrated in FIG. 43.
FIG. 45 is a side view of the pivotal blade as according to a blade-opening arrowhead preferred embodiment of this invention as illustrated in FIG. 43.
FIG. 46 is a side view of a fully threaded set screw as according to some of the blade-opening arrowhead preferred embodiments of this invention.
FIG. 47 is a side view of a partially threaded set screw as according to some of the blade-opening arrowhead preferred embodiments of this invention.

FIGS. 41–42 illustrate a blade-opening arrowhead 122 as according to another preferred embodiment of this invention. Arrowhead 122 has a blade 308 with a notch 358 located in the first end thereof, an arrowhead body 212 and a tip 295 having a rearwardly protruding catch lip 604 that serves to provide the function of a spacer element as according to this invention. Spacer element 604 is matably engaged within notch 358 of each blade 308 when blades 308 are in the retracted position, thus protecting cutting edges 320—320—320 from being dulled.

FIGS. 43–47 illustrate a blade-opening arrowhead 124 as according to another preferred embodiment of this invention. Arrowhead 124 has a blade stop washer 502, a blade 310 with a notch 360 located in the first end thereof, an arrowhead body 214 with an externally exposed annular groove 264, set screw hinge pin receiving hole 240, a tip 293, and a resilient spacer element 606. Spacer element 606 when blades 310—310—310 are in the retracted position is compressed by a flat 278 of tip 293 such that spacer element 606 generates an urging force so as to urge itself into engagement within each notch 360 when protecting cutting edges 320—320—320 from being dulled as according to the desired results of this invention. In this manner a single structural entity—spacer 606—performs dulling prevention means and retaining means as according to this invention, wherein while serving to prevent the abutment of cutting edges 320—320—320 with a substance spacer element 606 produces a bias force or an urging force so as to engage itself against the edge of each blade 310 when blades 310—310—310 are in the retracted position.

It is apparent that a variety of different numbers of structurally distinct elements as according to this invention can be utilized to perform the desired results thereof. For example, a single structural entity or a plurality of two or more structurally distinct elements or entities can provide the desired results of the retaining means, bias means, holding means, dulling prevention means, hover means, and soft contact means singularly or in various grouped combinations thereof.

FIGS. 48–51 illustrate a blade-opening arrowhead 126, and a blade-opening arrowhead 128 as according to other preferred embodiments of this invention. Arrowheads 126 & 128 each have an arrowhead body 216 with a externally exposed annular groove 266 formed thereabout to slidably receive annular spacers 602 therein. Spacer elements 602 prevent cutting edges 320 of each blade 300 from becoming dulled when in the retracted position by abutting directly against corresponding cutting edges 320. Spacer element 602 is preferably fabricated of a soft non-dulling material such as a rubber O-ring. An elastic band 608 as illustrated in FIG. 51 could also preferably provide the desired results of a spacer element as according to this invention.

Figure 54:
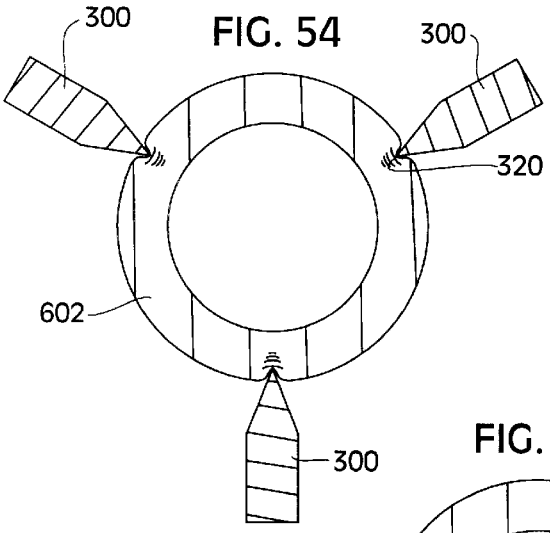
FIG. 54 is an enlarged cross-sectional top view of the spacer element as according to some of the blade-opening arrowhead preferred embodiments of this invention showing three pivotal blades in abutment thereagainst.
Figure 53:
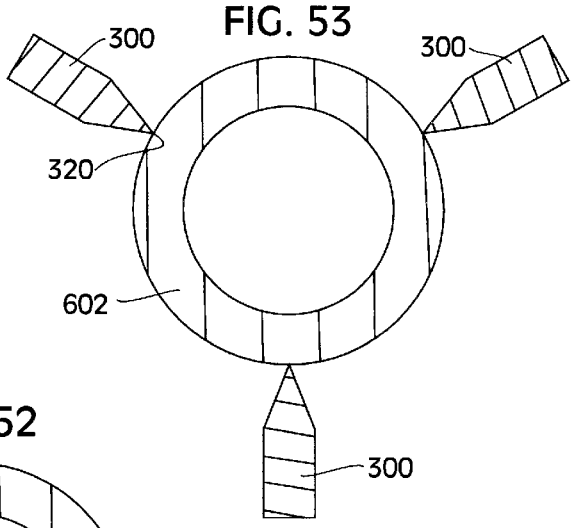
FIG. 53 is an enlarged cross-sectional top view of the spacer element as according to some of the blade-opening arrowhead preferred embodiments of this invention showing three pivotal blades in abutment thereagainst.
Figure 52:
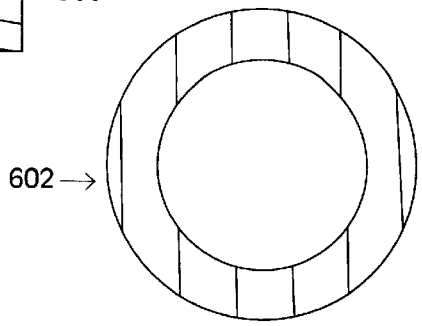
FIG. 52 is an enlarged cross-sectional top view of the spacer element as according to the blade-opening arrowhead preferred embodiment of this invention as illustrated in FIG. 48.

FIGS. 52–54 illustrate cross-sectional views of spacer 602 as taken along plane 53—53 of FIG. 48. Spacer element 602 as illustrated in FIG. 54 shows pivotal blades 300—300—300 abutting thereabout in such a manner so as to compress or deflect spacer 602 immediately whereupon cutting edges 320—320—320 abut thereagainst. FIG. 53 contrastingly shows pivotal blades 300—300—300 abutting against spacer 602 in such a manner so as to substantially not compress or deflect spacer 602 whereupon each cutting edge 320 abuts thereagainst. In either case FIG. 54 or FIG. 53 the sharp cutting edges 320—320—320 are protected from dulling since spacer element is preferably fabricated of a soft enough material or of a resilient material, such as rubber, so as to not alter the virgin structural integrity of the fine cutting edge 320 of each corresponding blade 300 when in the retracted position.

It is apparent that the force with which the blade edges of the blade-opening arrowheads as according to this invention are touched against a substance such as a spacer element or an accompanying arrowhead body may vary. It is also apparent that the force with which the blade edges of the blade-opening arrowheads as according to this invention are forced into a substance or pressured thereagainst may vary and still provide the desired results as envisioned by the scope of this invention.

It is apparent that the spacer elements as according to this invention such as spacer element 602 may be fabricated of a material such that the razor sharp cutting edges of the pivotal blades slightly cut into the spacer element whereupon when they abut thereagainst so as to provide more contact surface area of each sharpened edge with the spacer element such that the grind bevels or a grind bevel abut(s) thereagainst, while serving to prevent the respective cutting edges from being dulled as is according to the desired results and objectives of this invention.

Figure 56:
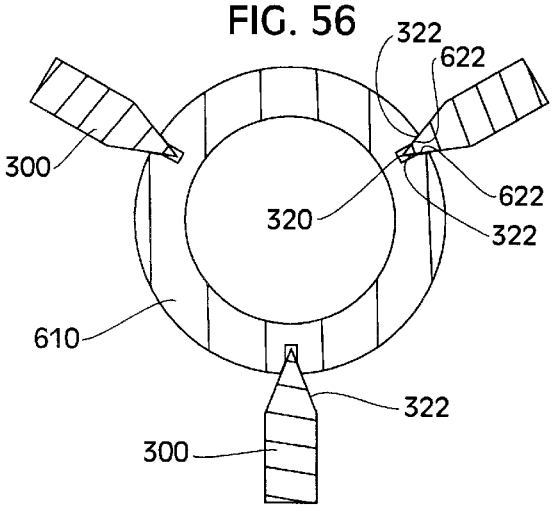
FIG. 56 is another view of the enlarged cross-sectional top view of the spacer element as illustrated in FIG. 55 showing three pivotal blades in abutment thereagainst.
Figure 55:
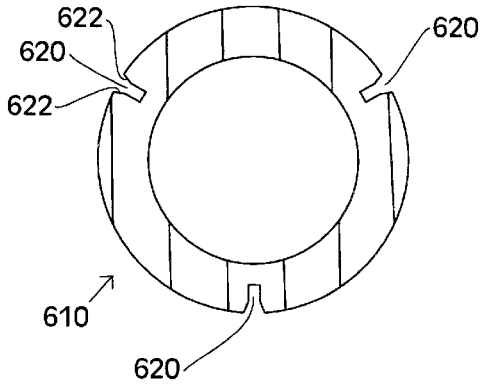
FIG. 55 is an enlarged cross-sectional top view of another spacer element as according to some of the blade-opening arrowhead preferred embodiments of this invention.

FIGS. 55–56 illustrate cross-sectional views of a spacer element 610 as according to yet other preferred embodiments of this invention. Spacer element 610 has a plurality of three voids 620—620—620 such that each void 620 has a pair of bevel abutting surfaces 622—622 that abut against grind bevels 322—322 of each blade 300 as is illustrated in FIG. 55. As also illustrated in FIG. 55 cutting edge 320 of each blade 300 when blades 300—300—300 are in the retracted position do not abut against a substance such as spacer element 610, but are protectedly housed within corresponding voids 620—620—620.

FIGS. 57–58 illustrate a blade-opening arrowhead 130 as according to another preferred embodiment of this invention. Arrowhead 130 has a removably attachable blade stop washer 504, a plurality of blades 312—312—312 pivotally hinged to arrowhead body 216 by annular hinge ring 452, and a conventional O-ring 410 stretched around the outside of blades 312—312—312 so as to exert an inward directed closing force thereupon at corresponding outer edges 390. Sharp cutting edge 320 of each blade 312 is prevented from being dulled by the abutment against spacer element 602 as is clearly illustrated in FIG. 57.

FIGS. 59–60 illustrate a blade-opening arrowhead 132 as according to another preferred embodiment of this invention. Arrowhead 130 has a plurality of blades 314—314—314 each having a notch 346 formed in an outer edge 390 thereof, and a conventional O-ring 412 stretched around the outside of blades 314—314—314 so as to be matably received within each notch 346 when exerting an inward directed closing force thereupon. Sharp cutting edge 320 of each blade 314 is prevented from being dulled by the abutment against spacer element 602 as is clearly illustrated in FIG. 59.

Figure 61:
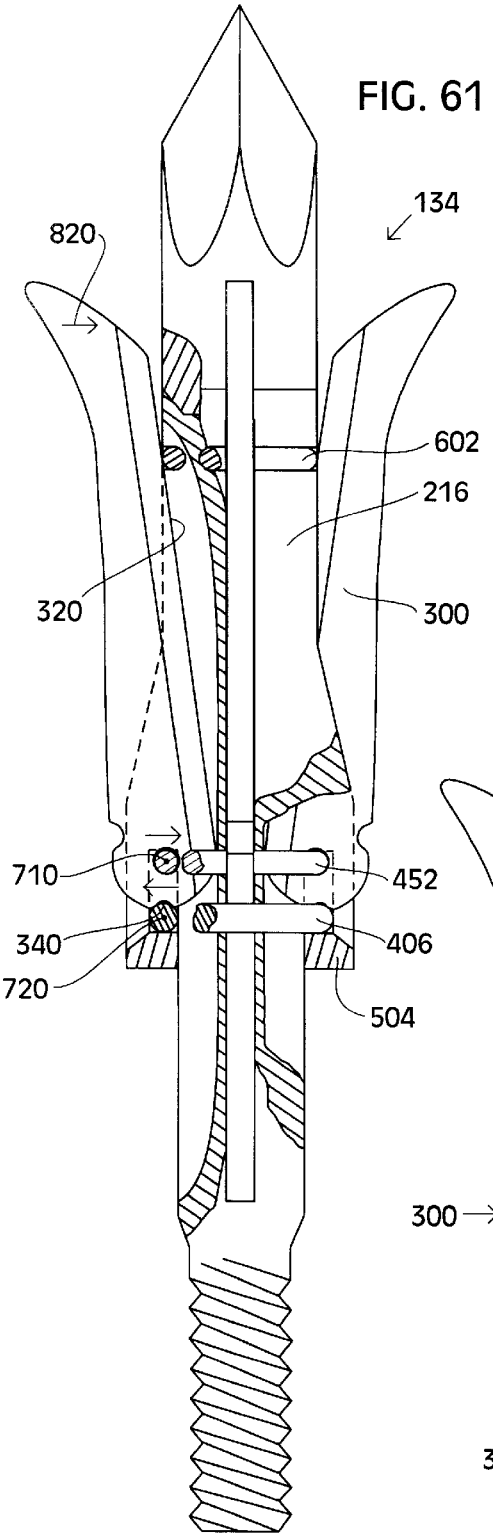
FIG. 61 is a longitudinal partial cross-sectional view of another blade-opening arrowhead preferred embodiment as according to this invention.
Figure 62:
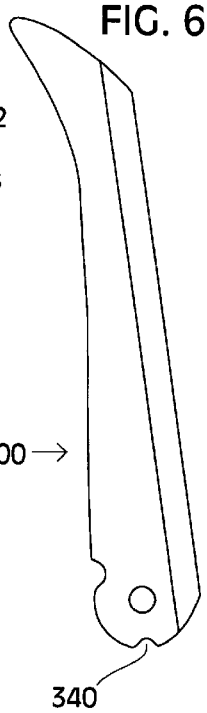
FIG. 62 is a side view of the pivotal blade as according to the blade-opening arrowhead preferred embodiments of this invention as illustrated in FIGS. 61 & 63.
Figure 63:
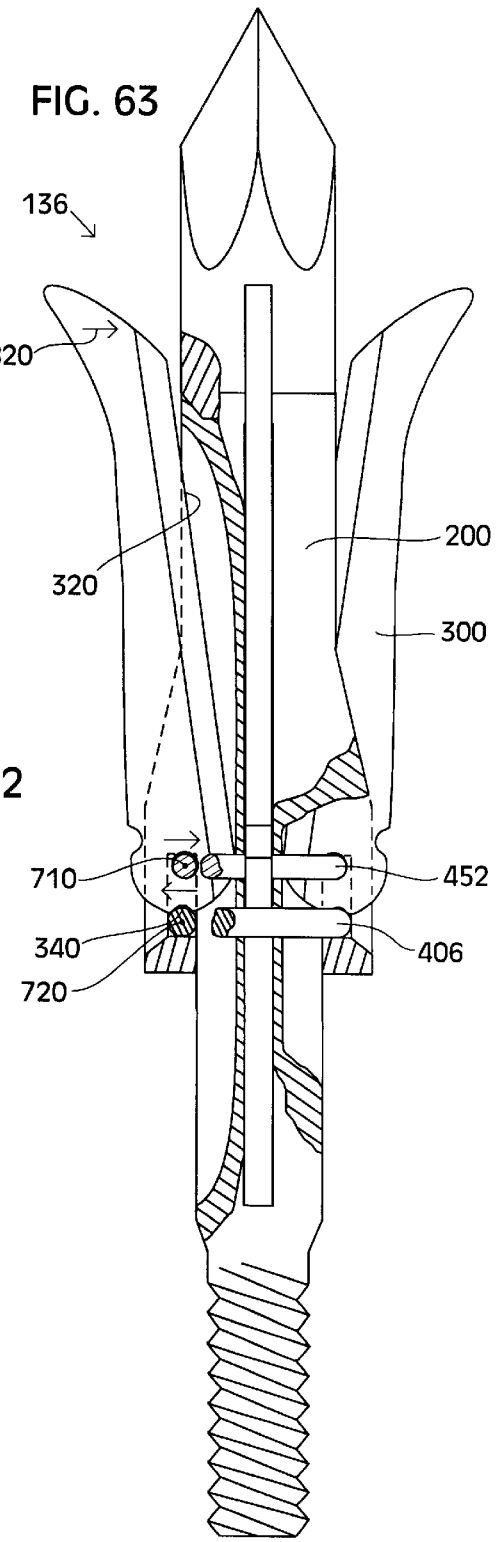
FIG. 63 is a longitudinal partial cross-sectional view of another blade-opening arrowhead preferred embodiment as according to this invention.

FIGS. 61–63 illustrate another example of dulling prevention means and retaining means as according to this invention, wherein a blade-opening arrowhead 134 as according to another preferred embodiment of this invention has an annular retaining means 406 comprising a resilient annular element such as a rubber O-ring which urges itself into engagement within each notch 340 of each blade 300. Annular element 406 is compressed in a substantially rearward direction so as to generate a forwardly directed urging force against the blade edges which in turn creates inwardly directed rotational force 820 so as to rotate cutting edge 320 of each blade into abutment with spacer element 602. It is apparent that annular element 406 can act as a rotational limiting element as according to this invention so as to limit the force with which cutting edges 320—320—320 are touched against spacer element 602, as is according to the desired results of the soft contact means of this invention. It is also apparent that annular element 406 can act as a rotational limiting element as according to this invention so as to displace cutting edges 320—320—320 a distance away from arrowhead body 200 as is clearly illustrated in FIG. 63 with a blade-opening arrowhead 136 as according to a preferred embodiment of this invention.

Figure 64:
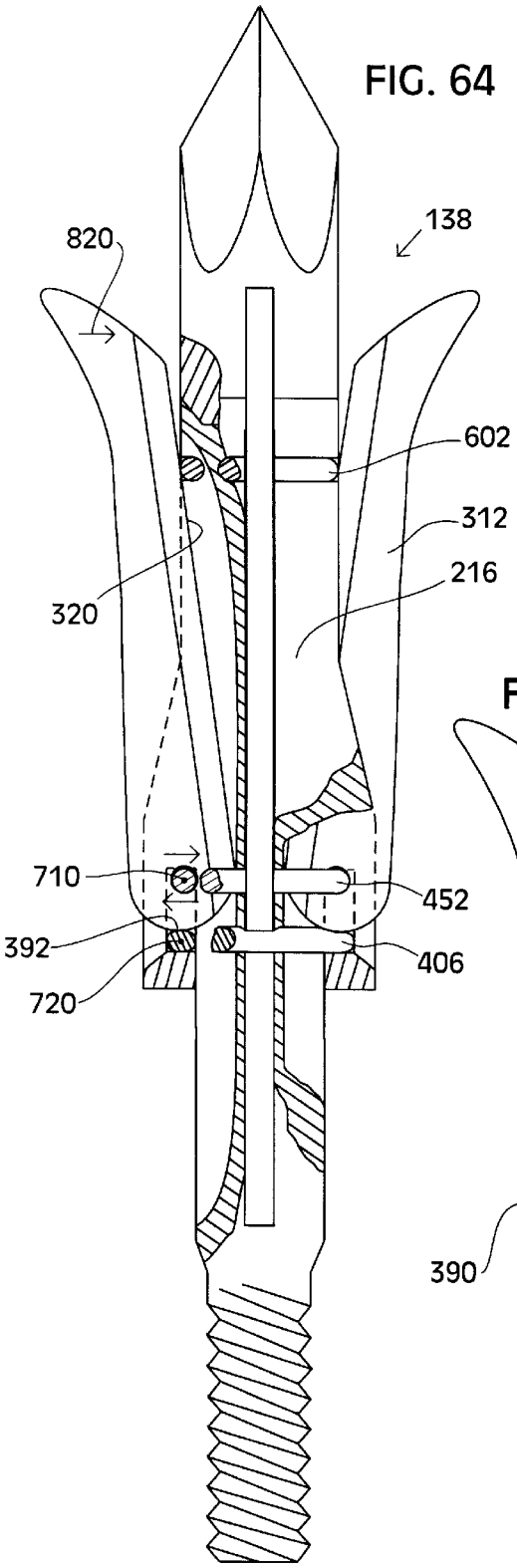
FIG. 64 is a longitudinal partial cross-sectional view of another blade-opening arrowhead preferred embodiment as according to this invention.
Figure 65:
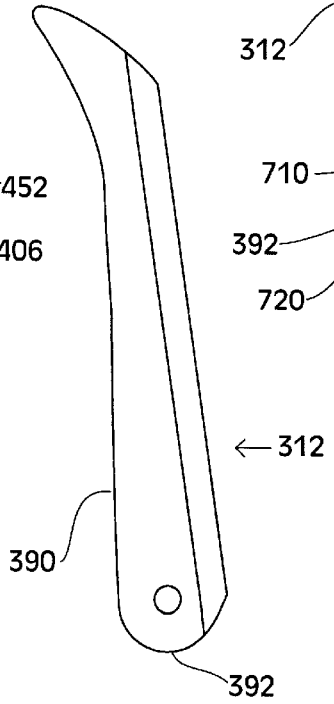
FIG. 65 is a side view of the pivotal blade as according to the blade-opening arrowhead preferred embodiments of this invention as illustrated in FIGS. 64 & 66.
Figure 66:
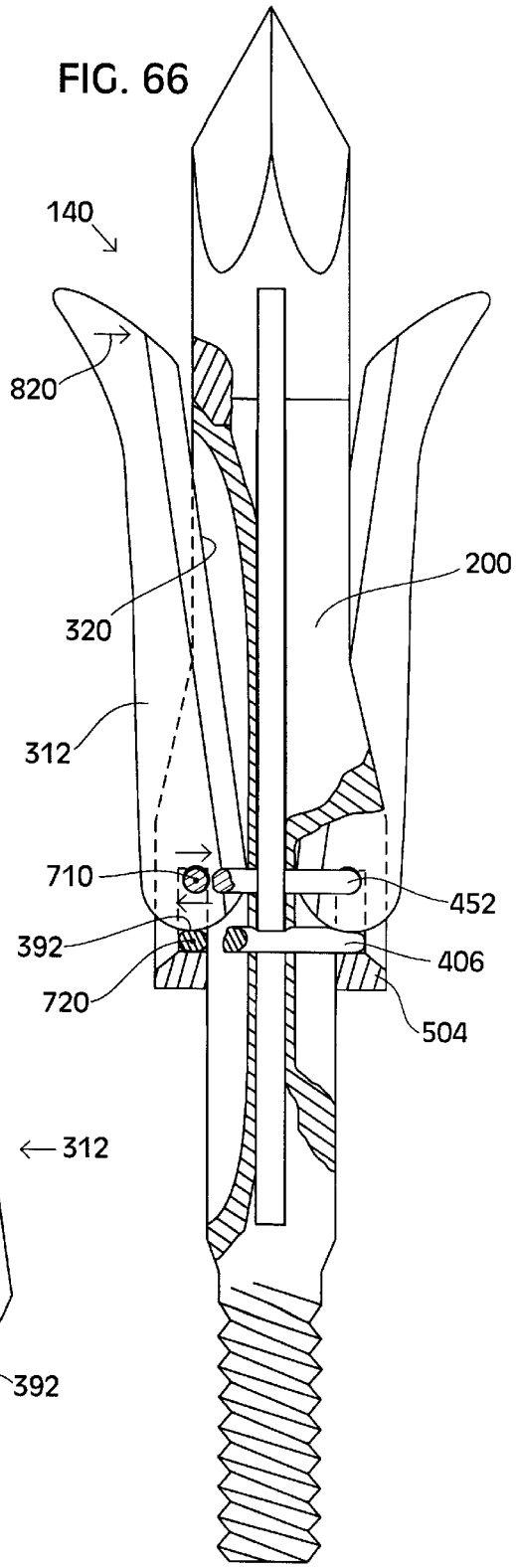
FIG. 66 is a longitudinal partial cross-sectional view of another blade-opening arrowhead preferred embodiment as according to this invention.
Figure 69:
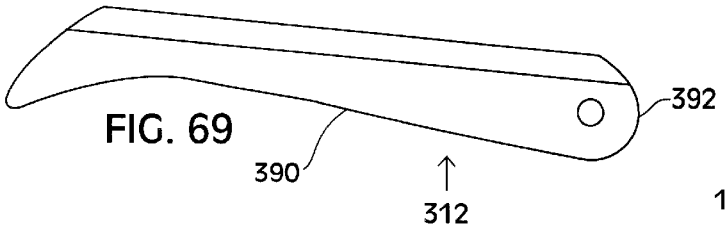
FIG. 69 is a side view of the pivotal blade as according to the blade-opening arrowhead preferred embodiment of this invention as illustrated in FIG. 67.
Figure 68:
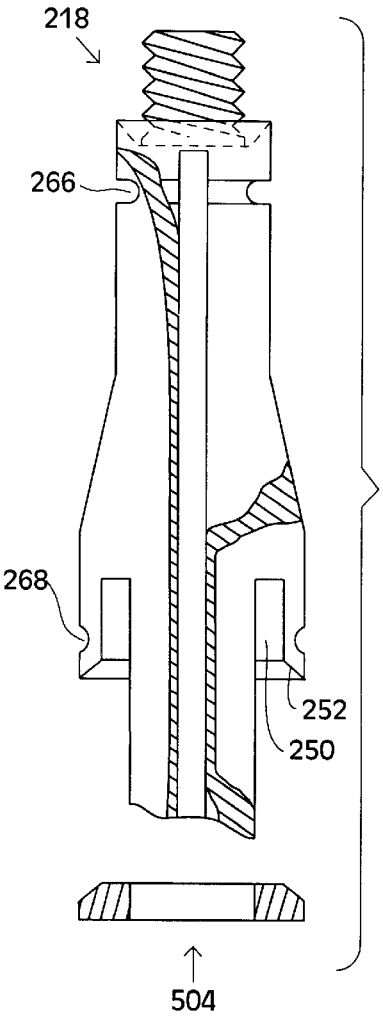
FIG. 68 is an exploded longitudinal partial cross-sectional view of the blade-opening arrowhead preferred embodiment as according to this invention as illustrated in FIG. 67.
Figure 71:
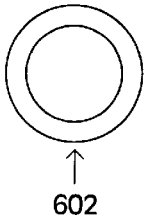
FIG. 71 is a top view of the spacer element as according to the blade-opening arrowhead preferred embodiment of this invention as illustrated in FIG. 67.
Figure 72:
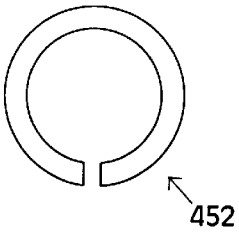
FIG. 72 is an top view of an annular blade ring as according to the blade-opening arrowhead preferred embodiment of this invention as illustrated in FIG. 72.
Figure 70:
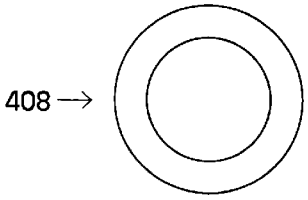
FIG. 70 is a top view of the retaining annular element as according to the blade-opening arrowhead preferred embodiment of this invention as illustrated in FIG. 67.

FIGS. 64–66 illustrate yet other examples of dulling prevention means, soft contact means, hover means and retaining means as according to this invention, wherein a blade-opening arrowhead 138 and a blade-opening arrowhead 140 are illustrated. Arrowheads 138 & 140 are similar to arrowheads 134 & 136 as described above in FIGS. 61–63, except arrowheads 138 & 140 utilize blades 312, and an annular resilient retaining means 406. The second end 392 of each blade 312 does not have a notch formed therein as does each blade 300. Annular resilient element 406 can act as a rotational limiting element as according to this invention so as to limit the force with which cutting edges 320—320—320 are touched against spacer element 602 as is illustrated in FIG. 64. Annular resilient element 406 can also act as a rotational limiting element as according to this invention so as to displace cutting edges 320—320—320 a distance away from arrowhead body 200 of arrowhead 140 as is clearly illustrated in FIG. 66. Preferably, annular element 406 is designed so as to frictionally grip with each blade edge at corresponding second blade ends 392 thereof so as to be enabled to preform the desired results as according to the rotational limiting elements, dulling prevention means and hovers means of this invention.

Figure 67:
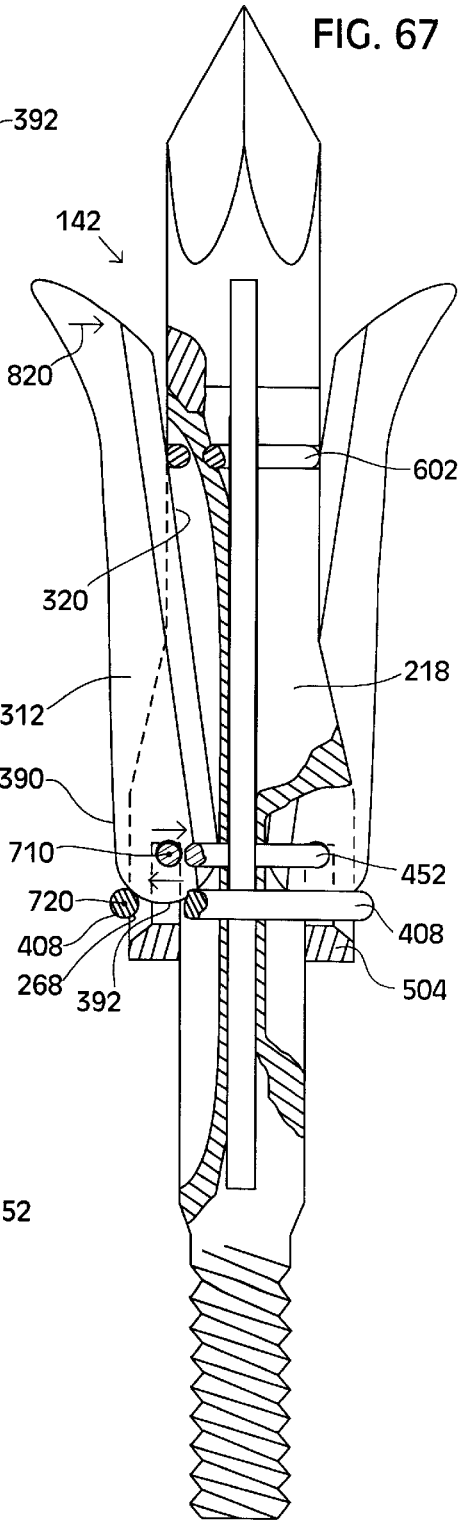
FIG. 67 is a longitudinal partial cross-sectional view of another blade-opening arrowhead preferred embodiment as according to this invention.

FIGS. 67–72 illustrate yet other examples of dulling prevention means, soft contact means and retaining means as according to this invention, wherein a blade-opening arrowhead 142 is illustrated. Arrowhead 142 is similar to arrowheads 134–140 as described above in that an annular resilient retaining means 408 as utilized by arrowhead 142 selectively retains or holds the blades in the retracted position by being deflected in a rearward direction so as to generate a forwardly directed urging force against the second end 392 of each blade 312. Annular resilient retaining means 408 is seated in an externally exposed annular groove 268 of an arrowhead body 218 as is illustrated in FIG. 67.

Figure 73:
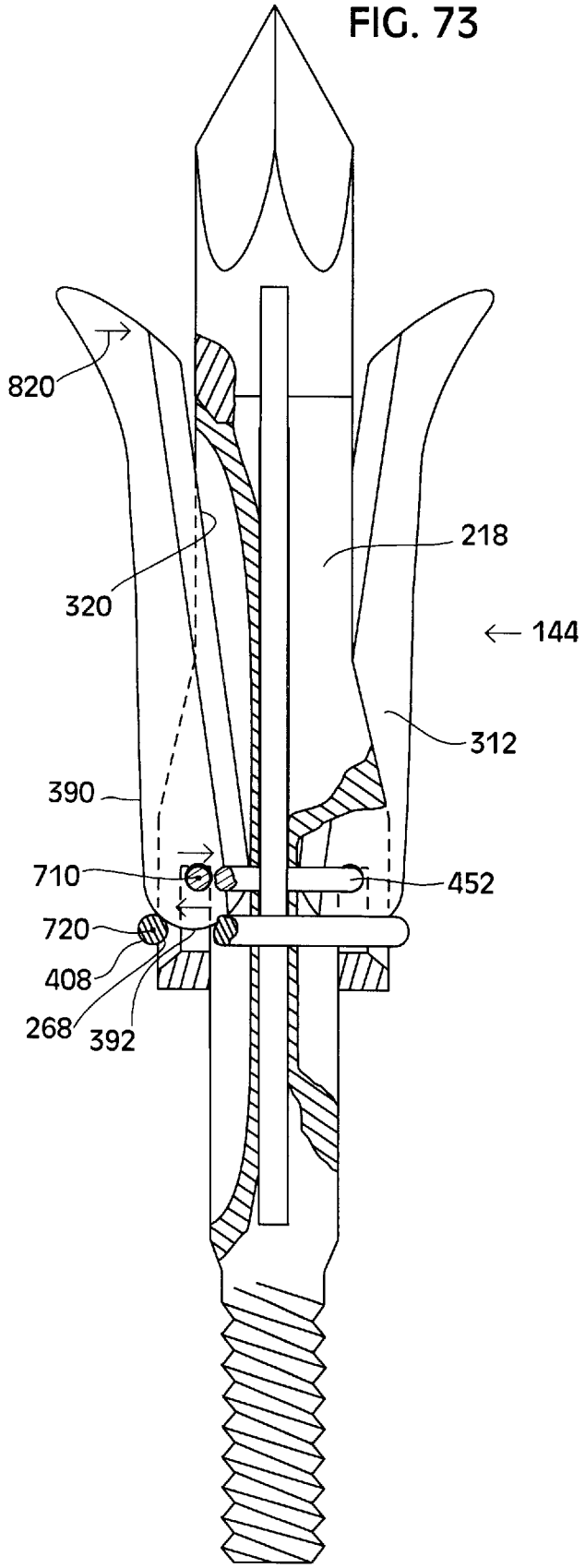
FIG. 73 is a longitudinal partial cross-sectional view of another blade-opening arrowhead preferred embodiment as according to this invention.
Figures 86, 87, 88, 89, 90, 91:
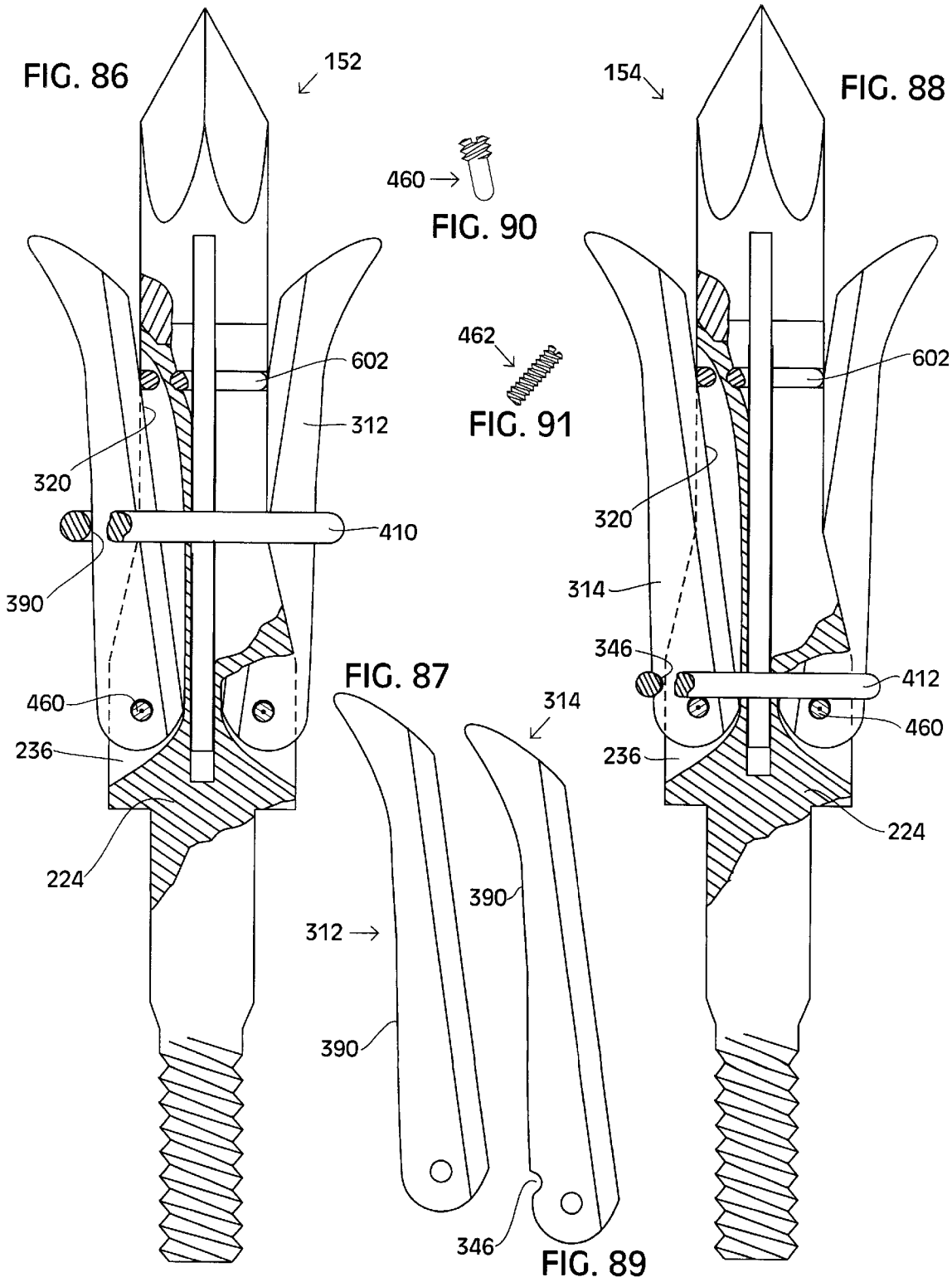
FIG. 86 is a longitudinal partial cross-sectional view of another blade-opening arrowhead preferred embodiment as according to this invention.
FIG. 87 is a side view of the pivotal blade as according to the blade-opening arrowhead preferred embodiment of this invention as illustrated in FIG. 86.
FIG. 88 is a longitudinal partial cross-sectional view of another blade-opening arrowhead preferred embodiment as according to this invention.
FIG. 89 is a side view of the pivotal blade as according to the blade-opening arrowhead preferred embodiment of this invention as illustrated in FIG. 88.
FIG. 90 is a side view of a partially threaded set screw as according to some of the blade-opening arrowhead preferred embodiments of this invention.
FIG. 91 is a side view of a fully threaded set screw as according to some of the blade-opening arrowhead preferred embodiments of this invention.

FIG. 73 illustrates another example of hover means as according to this invention, wherein a blade-opening arrowhead 144 is illustrated. Arrowhead 144 is similar to arrowhead 142 as described above in that annular resilient element 408 acts as a rotational limiting element to displace cutting edges 320—320—320 a distance away from arrowhead body 218 so that they do not contact a substance when in an in-flight, closed or retracted position.

FIGS. 74–80 illustrate a blade-opening arrowhead 146 as according to another preferred embodiment of this invention. Arrowhead 146 is similar to arrowhead 142 as described above except that arrowhead 146 utilizes straight set screw type hinge pins 460 or 462 for hinge means and therefore has an arrowhead body 220 with a plurality of blade slots 236—236—236 and a like number of hinge pin receiving holes 240.

FIGS. 81–85 illustrate a blade-opening arrowhead 148 and a blade-opening arrowhead 150 as according to other preferred embodiments of this invention. Arrowheads 148 & 150 are similar to arrowhead 146 as described above except that arrowheads 148 & 150 utilize a plurality of pivotal blades 316—316—316 each having a notch 348 formed in the edge of corresponding blades near the juncture of the outer blade edge 390 and second blade end edge 392, and arrowhead 150 has an arrowhead body 222 configured such so as to not utilize a spacer element for dulling prevention. Annular resilient element 408 urges itself into engagement within notch 348 of each blade 316 so as to cause the first ends of each blade 316 to rotate inwardly. As illustrated in FIG. 81 cutting edge 320 of each blade 316 abuts against spacer element 602 when in the retracted position. As illustrated in FIG. 82 cutting edge 320 of each blade 316 does not abut against a substance when blades 316—316—316 are in the retracted position. Retaining means annular element 408 also acts as a rotational limiting element as according to this invention, wherein particularly annular element 408 limits the distance that each blade 316 is displaced away from corresponding arrowhead bodies when in the retracted position by engagement within corresponding notches 348.

FIGS. 86–91 illustrate a blade-opening arrowhead 152 and a blade-opening arrowhead 154 as according to yet other preferred embodiments of this invention. Arrowheads 152 & 154 are similar to arrowheads 130 & 132 as described above in FIGS. 57–60 except arrowheads 148 & 150 utilize straight set screw type hinge pins 460 or 462 for hinge means and therefore each have an arrowhead body 224. Arrowhead body 224 of arrowhead 152 as well as arrowhead bodies 220 & 222 of arrowheads 146, 148 & 150 do not have a removably attachable blade stop washer to provide the blade stop means, but rather have a curved or sloped rear portion of corresponding blade slots for blade stop means which abut with the blades when the blades are rotated to the open position so as to define the cutting diameter of the arrowhead.

According to this invention, each blade is preferably housed in a respective blade slot or equivalent, configured to receive the blade or blades. Even though the blade slot or slots, have been depicted as being in substantial parallel alignment with the longitudinal axis of the arrowhead body so as to be radially aligned therewith, it is apparent that the blade slots may be non-radially orientated with respect to their arrowhead body central longitudinal axis. It is apparent that the blades when rotated to the fully open position may also be disposed in a plane that is inclined to the arrowhead body central longitudinal axis so as to impart spinning of the arrowhead upon penetration of a target.

Although the preferred embodiments of this invention have been depicted as having a plurality of three pivotal blades each with only one blade disposed in each corresponding blade slot, it is apparent that the blade-opening arrowheads according to this invention may have any number of blades, with two, three or four being preferred. It is also apparent that more than one blade may be housed or contained in a single slot—particularly where a straight hinge pin has a plurality of at least two blades attached thereon. It is apparent that the blade-opening arrowheads according to this invention may have stationary or fixed blades attached to the arrowhead body in combination with the pivotal blades as disclosed herein.

It is apparent that different dulling prevention means, hover means, soft contact means, rotational limiting elements, spacer elements, retaining means, bias means, holding means, hinge means and other elements and their equivalents, as discussed above and according to other preferred embodiments of this invention, can be changed, or interchanged, or eliminated, or duplicated, or made of different materials, and connected to or associated with adjacent elements in different manners, other than suggested herein, without deterring from the desired results of the blade-opening arrowheads according to this invention.

It is to be understood that the present invention is not limited to the sole embodiments described above, as will be apparent to those skilled in the art, but encompasses the essence of all embodiments, and their legal equivalents, within the scope of the following claims.

I claim:

1. A blade-opening arrowhead comprising:

(a) an arrowhead body;

(b) a blade having a first end, an opposing second end and an edge extending thereabout, said edge having a sharpened cutting edge;

(c) hinge means for pivotally connecting said second end of said blade to said arrowhead body to enable said blade to rotate between a retracted position wherein said blade is positioned adjacent to said arrowhead body and an open position wherein said first end of said blade is rotated away from said arrowhead body; and (d) dulling prevention means for preventing said sharpened cutting edge from being dulled when said blade is in said retracted position, said dulling prevention means comprising a spacer element abutting against said edge of said blade when said blade is in said retracted position.

2. A blade-opening arrowhead comprising:

(a) an arrowhead body;

(b) a blade having a first end, an opposing second end and an edge extending thereabout, said edge having a sharpened section for cutting;

(c) hinge means for pivotally connecting said second end of said blade to said arrowhead body to enable said blade to rotate between a retracted position wherein said blade is positioned adjacent to said arrowhead body and an open position wherein said first end of said blade is rotated away from said arrowhead body; and (d) a spacer element mounted on said arrowhead body to abut against said edge when said blade is in said retracted position so that said sharpened section does not contact said arrowhead body.

3. A blade-opening arrowhead as recited in claim 2 wherein said spacer element abuts against said first end of blade.

4. A blade-opening arrowhead as recited in claim 3 wherein said first end of said blade has a notch formed therein, said notch engaging with said spacer element when said blade is in said retracted position.

5. A blade-opening arrowhead as recited in claim 2 wherein said spacer element comprises holding means for engaging against said edge of said blade so as to selectively hold said blade adjacent to said arrowhead body when said blade is in said retracted position.

6. A blade-opening arrowhead as recited in claim 5 wherein said spacer element comprises a protrusion extending from said arrowhead body.

7. A blade-opening arrowhead as recited in claim 5 wherein said spacer element comprises a discrete annular element engaged against said edge of said blade at said second end thereof.

8. A blade-opening arrowhead as recited in claim 2 wherein said spacer element is a resilient annular element removably mounted on said arrowhead body at a location substantially near a forward tip end thereof.

9. A blade-opening arrowhead comprising:

(a) an arrowhead body;

(b) a blade having a first end, an opposing second end and an inner cutting edge;

(c) hinge means for pivotally connecting said second end of said blade to said arrowhead body to enable said blade to rotate between a retracted position wherein said blade is positioned adjacent to said arrowhead body and an open position wherein said first end of said blade is rotated away from said arrowhead body; and (d) a spacer element mounted on said arrowhead body to abut against said cutting edge when said blade is in said retracted position so that said cutting edge is displaced a distance away from said arrowhead body and does not contact said arrowhead body thereupon.

10. A blade-opening arrowhead as recited in claim 9 wherein said spacer element is fabricated of a substantially non-dulling material so that said cutting edge is not dulled when said blade is in said retracted position.

11. A blade-opening arrowhead as recited in claim 9 wherein said spacer element comprises an annular element.

12. A blade-opening arrowhead as recited in claim 9 further comprising positioning means for limiting displacement of said spacer element so that said spacer element is mounted upon said arrowhead body at a location so as to displace said cutting edge a distance from said arrowhead body.

13. A blade-opening arrowhead as recited in claim 9 wherein said spacer element is removably attachable from said arrowhead.

14. A blade-opening arrowhead as recited in claim 9 wherein a substantial portion of said inner cutting edge is substantially straight.

15. A blade-opening arrowhead as recited in claim 9 wherein said blade further comprises an outwardly projecting wing located at said first end of said blade, at least a section of said wing being exposed a distance outward from said arrowhead body when said blade is in said retracted position.

16. A blade-opening arrowhead comprising:

(a) an arrowhead body;

(b) a blade having a first end, an opposing second end and an inner cutting edge;

(c) hinge means for pivotally connecting said second end of said blade to said arrowhead body to enable said blade to rotate between a retracted position wherein said blade is positioned adjacent to said arrowhead body and an open position wherein said first end of said blade is rotated away from said arrowhead body; and (d) an annular element mounted on said arrowhead body to abut against said cutting edge when said blade is in said retracted position so that said cutting edge is displaced a distance away from said arrowhead body and does not contact said arrowhead body thereupon.

17. A blade-opening arrowhead as recited in claim 16 wherein said annular element is comprised of a resilient material.

18. A blade-opening arrowhead as recited in claim 16 wherein said annular element is an elastic band.

19. A blade-opening arrowhead as recited in claim 16 wherein said annular element is a rubber O-ring.

20. A blade-opening arrowhead as recited in claim 16 wherein said arrowhead body further comprises an exteriorly exposed annular groove, said annular element being seated within said annular groove when said cutting edge is abutting thereagainst.

21. A blade-opening arrowhead as recited in claim 16 wherein said inner cutting edge of said blade is folded adjacent to said arrowhead body when in said retracted position so as to be closer to a central longitudinal axis of said arrowhead body than an outer blunt edge of said blade is from said longitudinal axis.

22. A blade-opening arrowhead as recited in claim 16 wherein said annular element prevents said cutting edge from being dulled by contact with said arrowhead body when said blade is in said retracted position.

23. A blade-opening arrowhead as recited in claim 16 wherein said blade further comprises an outwardly projecting wing located at said first end of said blade, at least a section of said wing being exposed a distance outward from said arrowhead body when said blade is in said retracted position.

24. A blade-opening arrowhead comprising:

(a) an arrowhead body;

(b) a blade having a first end, an opposing second end and an edge extending thereabout, said edge having a sharpened cutting edge;

(c) hinge means for pivotally connecting said second end of said blade to said arrowhead body to enable said blade to rotate between a retracted position wherein said blade is positioned adjacent to said arrowhead body and an open position wherein said first end of said blade is rotated away from said arrowhead body, said sharpened cutting edge facing toward said arrowhead body when said blade is in said retracted position; and (d) dulling prevention means for preventing said sharpened cutting edge from being dulled when said blade is in said retracted position, said dulling prevention means comprising a spacer element abutting against said edge of said blade when said blade is in said retracted position.

25. A blade-opening arrowhead as recited in claim 24, wherein said first end of said blade rotates in a rearward direction relative to said arrowhead body, when said blade is rotating from said retracted position toward said open position.

26. A blade-opening arrowhead comprising:

(a) an arrowhead body;

(b) a blade having a first end, an opposing second end and an inner cutting edge;

(c) hinge means for pivotally connecting said second end of said blade to said arrowhead body to enable said blade to rotate between a retracted position wherein said blade is positioned adjacent to said arrowhead body and an open position wherein said first end of said blade is rotated away from said arrowhead body; and (d) an annular elastic band mounted on said arrowhead body to abut against said inner cutting edge when said blade is in said retracted position so that said inner cutting edge is displaced a distance away from said arrowhead body so as to not contact said arrowhead body.

27. A blade-opening arrowhead comprising:

(a) an arrowhead body;

(b) a blade having a first end, an opposing second end and an inner cutting edge;

(c) hinge means for pivotally connecting said second end of said blade to said arrowhead body to enable said blade to rotate between a retracted position wherein said blade is positioned adjacent to said arrowhead body and an open position wherein said first end of said blade is rotated away from said arrowhead body; and (d) an annular rubber O-ring mounted on said arrowhead body to abut against said inner cutting edge when said blade is in said retracted position so that said inner cutting edge is displaced a distance away from said arrowhead body so as to not contact said arrowhead body.

* * * * *